US005386493A

United States Patent [19]

Degen et al.

[11] Patent Number: 5,386,493

[45] Date of Patent: Jan. 31, 1995

[54] APPARATUS AND METHOD FOR PLAYING BACK AUDIO AT FASTER OR SLOWER RATES WITHOUT PITCH DISTORTION

[75] Inventors: Leo M. W. F. Degen, Menlo Park, Calif.; Martijn Zwartjes, Utrecht, Netherlands

[73] Assignee: Apple Computer, Inc., Cupertino, Calif.

[21] Appl. No.: 951,239

[22] Filed: Sep. 25, 1992

[51] Int. Cl.[6] ..... G10L 9/00

[52] U.S. Cl. ..... 395/2.76; 395/2.69

[58] Field of Search ..... 395/2.87, 2.67–2.78; 381/51–53

[56] References Cited

U.S. PATENT DOCUMENTS

| | | | |
|---|---|---|---|
| 4,375,083 | 2/1983 | Maxemchuk | 395/2.87 |
| 4,441,201 | 4/1984 | Henderson et al. | 395/2.74 |
| 4,852,168 | 7/1989 | Spraque | 395/2.69 |

OTHER PUBLICATIONS

Kamel, R., Emami, K., and R. Eckert. "PX: Supporting Voice in Workstations" *IEEE* pp. 73–80, Aug. 1990.

Ades, S. and D. Swinehart. "Voice Annotation and Editing in a Workstation Environment" *Xerox Parc. CSL-86-3*, Sep. 1986, pp. 1–20.

Lent, Keith. "An Efficient Method for Pitch Shifting Digitally Sampled Sounds" *Computer Music Journal*, vol. 13, No. 4. 1989, pp. 65–71.

*Primary Examiner*—Allen R. MacDonald
*Assistant Examiner*—Michelle Doerrler
*Attorney, Agent, or Firm*—Blakely, Sokoloff, Taylor & Zafman

[57] ABSTRACT

A computer implemented apparatus and method for modifying the playback rate of a previously stored audio or voice data file stored within a computer system without altering the pitch of the audio data file as originally stored. The present invention also maintains a high level of sound quality during playback. The present invention includes a double buffering system in order to perform all of the desired calculations in real time. A time stretching technique is employed upon the audio data file to decrease or increase playback rate which creates audio segments requiring joining processing. Junctions are smoothed by employing a cross-fade amplitude envelope filter and a compressor/limiter is used to maintain filter range. The system may operate on a desktop computer allowing for advantageous playback and audio data management options of stored voice and or sound data.

46 Claims, 7 Drawing Sheets

APPARATUS AND METHOD FOR PLAYING BACK AUDIO AT FASTER OR SLOWER RATES WITHOUT PITCH DISTORTION

BACKGROUND OF THE INVENTION

1. Field of the Invention

The present invention relates to the field of audio playback technology and techniques. More specifically the present invention relates to audio playback technology situated in a computer controlled environment running on a software driven platform.

2. Prior Art

Audio data is increasingly being used with and incorporated into the desktop computer environment allowing computer users more flexibility in data management. Audio data, in the form analog information signals stored on a flexible tape or in a digital format stored in a computer's memory or hard drive, can be retrieved from these storage mediums by the computer system and played through an internal computer speaker to an end user. Software control routines and programs residing on a typical desktop computer act to control, through a user interface, the interaction of the user and the audio data desired for playback. Special menus and display formats allow previously stored audio data to be accessed readily by the user, i.e. with a mouse and display screen.

Audio voice data is currently used in desktop computer systems in a variety of ways and for a variety of functions. For example audio voice data can be used for recording dialog sessions, such as instructions given to a secretary. Voice data located by displayable "tags" can be placed within a text document on a display screen to give personalized instructions on the proper way to amend a particular document when the tag is activated, such as by a mouse or other user input device. Voice data is also used as a means for dictation where a document is spoken into a dictation device for a typist or data entry secretary. Voice data can also be used for recording scratch notes by the user for future reference or reminders which can be accessed by the user interface software of the desktop computer. Voice data can be used to record meeting information or interview sessions and for recording class instructions for later playback. Also, voice data is effectively used over a computer system as a new means of electronic mail by voice message, instead of text.

Computer systems are a natural and progressive platform to interface with recorded voice data because computer systems offer an unlimited amount of avenues to access previously recorded data. For instance, a regular tape cassette player records voice data on a continuous playing tape, usually with two sides, A and B. In order to playback a certain portion of voice data, the cassette must cycle through all of the preceding tape segments before the target: portion is reached thus creating a large access delay for a target portion and also generating a good deal of wasted playback for unwanted voice segments. Further, if a particular voice segment is not localized or identified originally, one must play through all of the tape to locate the segment because of the serial nature of the tape medium. This is true because most tape storage mediums to not allow for easy marking of tape portions for playback at those tagged selections.

A computer system is uniquely designed to handle these problems. A computer system can "tag" selected portions of voice data and remember where in the storage medium they have been placed for easy and ready playback. A computer system is not limited to a tape storage device and can place voice data in a memory unit such as on board RAM or within a disk drive storage unit. Both memory storage devices named above provide for quick and easy access to any audio segment without wasted or excessive accessing as with a conventional cassette tape.

Audio and voice data also complements the computer system's use as an information processing tool. Voice data along with graphics and text provide more information available to a user in a "user-friendly" or "personalized" environment. Thus, instead of receiving tasks or lists of things "to do" a user might find a familiar voice carrying instructions for the user that were pre-recorded by another. Also, computer driven "voice-mail" creates more efficient and personalized way to transmit and receive office memos or other communications between users of interconnected computer systems.

Currently, audio or voice data can be stored directly into a computer memory storage unit in digital form. This provides an easy method for playback, however, does not allow for liberal voice storage capacity as 25 milliseconds of voice storage can consume up to 500 bytes of data depending on the storage format and the sample rate and sample size. Voice data can also be stored on a specialized tape or cassette player which interfaces to the computer system. The computer system would then control the accessing scheme and playback rates of the cassette player and the voice data would be fed by the player into the computer for processing and translation into digital form, if needed. Using at least these two storage and playback methods, voice or audio data can conveniently be incorporated into a computer system and used advantageously by a computer user.

Therefore, it is clear that voice and audio data will become one of the next information forms utilized heavily by modern computers. Devices and techniques that can manage effectively and process computer driven audio data wilt be inherently advantageous to these computer systems. The present invention is drawn to an apparatus and method to better provide access to prerecorded audio and voice data which is accessed by use of a computer system. The present invention allows users to move efficiently access previously stored audio data.

Even within computer systems that integrate audio data and user interfaces for playback, some inefficiencies do exist in the way in which audio data is selected. For instance, once a particular segment of audio data is reached, i.e. because it was previously tagged with a special locator, a user may only desire to listen to a particular phrase or data packet within the segment. Or a user may want to increase the playback rate of the audio data. Therefore, the user will playback the entire segment waiting for that desired phrase or data. In this case the user is "scanning" the tape segment for the desired portion. It is desirable, then, to provide a method and apparatus of speeding up the playback rate of unwanted audio data while at the same time providing intelligible playback audio so that the user can quickly identify the desired phrase. The present invention provides such a function and apparatus.

Some prior art systems allow users to listen to messages at double speed. This technique is accomplished by modifying the previously stored audio data. The result is that undesirable clicks and noises appear at the spaces where modifications occur, which may be separated by only 20–25 milliseconds. This creates unacceptable background noise and "hissing" sounds which reduces the quality of the sounds. Also, musicians use analog and digital sound processing units to change the pitch of an audio signal in real time without changing its duration; this is called Harmonizing. The processing hardware and software complexity required for Harmonizing makes it undesirable for desktop computer applications. Lastly, Time Domain Scaling is available to transform a sampled sound with a speed change into a sampled sound that has the pitch of the original sampled sound, but a different duration. Although the sound quality of these systems is high, they do not process the sound playback in real-time and therefore are not advantageous for use in desktop computer systems. The present invention operates in real-time to process the selected audio file for playback.

In some prior art systems that manipulate audio data, the playback speed of the stored audio data changes which causes perceptual problems and the audio data may not be understood by a listener. In many cases, playback speed is changed by doubling the rate that the audio information is presented to the user. These manipulations alter the duration of the playback sound. A side-effect of this kind of manipulation is a pitch change in the resulting playback sound. This pitch change is often referred to as a "chipmunk" effect because of the resultant high pitch sound of the playback voices when playback at high speeds. The playback data loses affect, gender information and is generally less intelligible than the original recording. This is a problem because playback audio data that cannot be understood is useless. What is needed in order to preserve this audio information during playback is a system to scale the resulting sound back to its original pitch while allowing for rapid playback rates for scanning purposes. The present invention provides for such functions.

Therefore, it is an object of the present invention to provide an efficient apparatus and method to speed-up and slow-down the playback rate of previously recorded audio data in a computer system environment without altering the playback pitch of that data. It is also an object of the present invention to provide an efficient apparatus and method to speed-up and slow-down the playback rate of previously recorded audio data in a computer system environment without altering the intelligibility of the playback data and eliminating undesirable "clicks and pops" in the playback. It is another object of the present invention to provide an efficient apparatus and method to speed-up and slow-down the playback rate of previously recorded audio data in real-time.

It is an object of the present invention to provide these functions on a desktop computer system without the need for specialized hardware. It is an object of the present invention to provide such functionality in an easy to use or "user-friendly" interface of the computer system. These objects and others not expressly stated will become clear as the present invention is expanded in the detailed description of the present invention.

3. Related U.S. Patent Application

The present application relates to a co-pending application concurrently filed with the present application and entitled, "Recording Method and Apparatus and Audio Data User Interface" invented by Leo Degen, S. Joy Mountford, and Richard Mander, Ser. No. 07/951,579, filed on Sep. 25, 1992, and assigned to the assignee of the present application. The above referenced patent application is herein incorporated by reference.

SUMMARY OF THE INVENTION

The present invention includes, a computer implemented apparatus and method for increasing or decreasing playback rate of a previously stored audio data file without increasing or decreasing playback pitch of the audio data file, the computer implemented apparatus includes: a first buffer means for storage of the audio data file; a time stretching means for selecting a first portion of a predetermined length of the audio data file from the first buffer means, the first portion having a start and an end point, the time stretching means also for selecting a second portion of a predetermined length of the audio data file from the first buffer means, the second portion having a start and an end point, the time stretching means includes: a means for excluding intermediate data of the audio data file which are located between the end point of the first portion and the start point of the second portion; and a means for increasing the first portion by replicating the end point of the first portion and also for increasing the second portion by replicating the end point of the second portion; a filter means for fading out the end point of the first portion and for fading in the start point of the second portion, the filter means coupled to the means for increasing,: and an audio processing means for outputting a continuous audible signal by first processing the first portion and then processing the second portion.

The preferred embodiment of the present invention also includes a computer implemented apparatus as described above further including a limiting means for limiting the filter means such that the fading in and the fading out are constrained within a predetermined domain, the limiting means coupled to the filter means and also coupled to the audio processing means.

BRIEF DESCRIPTION OF THE DRAWINGS

FIG. 6(*b*) is an illustration of audio data segments in sequence and also predetermined portions to be excluded to increase the playback rate.

FIG. 6(*c*) illustrates the junctions formed by the present invention by combining selected segments in sequence.

FIG. 6(*d*) is an illustration of audio data segments in sequence and also predetermined portions replicated to decrease the playback rate FIG. 7(*a*) shows an example of a cross-fade amplitude filter used by the present invention.

FIG. 7(*c*) illustrates an output sound signal of the present invention whose playback rate has been modified and that has been processed in real time to eliminate noise.

DETAILED DESCRIPTION OF THE INVENTION

The present invention includes an apparatus and method for real-time speed-up and slow-down of an audio playback rate without modifying the pitch of the playback. The present invention also provides for intelligible playback in this mode of operation without unwanted "clicks" or noises. The present invention accomplishes these functions by utilizing a Macintosh TM computer system and various sound management tool software applications. An application, SoundBrowser, provides an environment in which the Sound Manager Toolbox can be used. The present invention includes a double buffering method to retrieve the original playback audio data. The sound is then processed by time stretching techniques and an audio filter is applied to the ends of audio segment which were cut by the time stretching technique, this is called Amplitude Envelope Processing. Specifically a Cross-Fade algorithm is utilized as the Amplitude Envelope Filter in order to smooth the junctions created by the time stretching technique. The result is a novel and advantageous system that allows for real-time speed-up and slowdown of the audio data without undesired noises. The present invention can operate effectively on a desktop computer system, such as a Macintosh TM platform available from Apple Computer Inc., of Cupertino, Calif.

In the following detailed description of the present invention numerous specific details are set forth in order to provide a thorough understanding of the present invention. However, it will be obvious to one skilled in the art that the present invention may be practiced without these specific details. In other instances well known methods have not been described in detail as not to unnecessarily obscure the present invention.

The preferred embodiment of the present invention is implemented on an Apple Macintosh TM computer system using the Finder TM user interface and is advantageously used as a unit within the application called SoundBrowser which provides an environment in which the Sound Manager Toolbox can be used. The present invention is also implemented in C language (Symantec Corporation THINK C TM Version 5.0.2 January, 1992). However, it is easily recognized that alternative computer systems and software applications may be employed (e.g. pen and tablet based systems) to realize the novel and advantageous aspects of the present invention. Further, it is appreciated that the present invention can advantageously be utilized outside of the SoundBrowser environment, such as for use within an electronically controlled phone recording and playback system, or other audio processing system.

Figure 1:
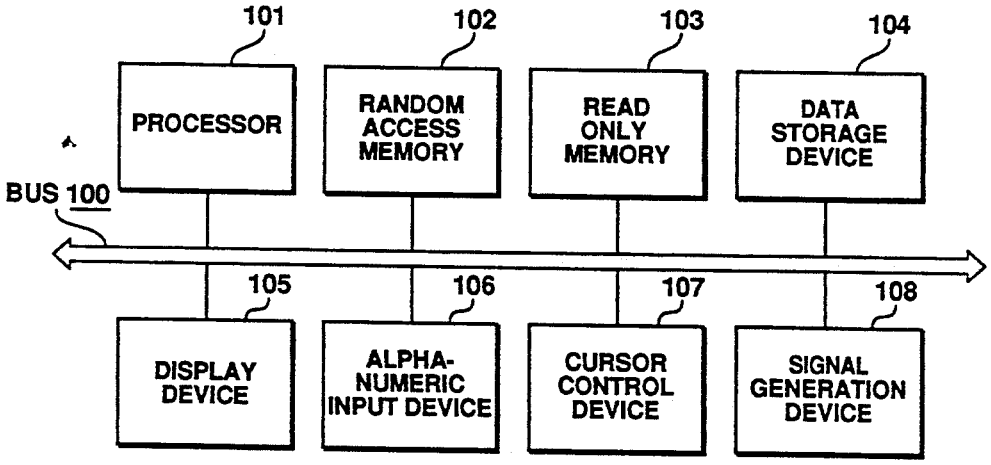
FIG. 1 is block diagram of a computer system in and with which the present invention can be implemented.

In general, computer systems used by the preferred embodiment of the present invention as illustrated in block diagram format in FIG. 1, comprise a bus 100 for communicating information, a central processor, 101 coupled with the bus for processing information and instructions, a random access memory 102 coupled with the bus 100 for storing information and instructions for the central processor 101, a read only memory 103 coupled with the bus 100 for storing static information and instructions for the processor 101, a data storage device 104 such as a magnetic disk and disk drive coupled with the bus 100 for storing information (such as audio or voice data) and instructions, a display device 105 coupled to the bus 100 for displaying information to the computer user, an alphanumeric input device 106 including alphanumeric and function keys coupled to the bus 100 for communicating information and command selections to the central processor 101, a cursor control device 107 coupled to the bus for communicating user input information and command selections to the central processor 101, and a signal generating device 108 coupled to the bus 100 for communicating command selections to the processor 101.

In the present invention the signal generation device 108 includes, as an input device, includes a standard microphone to input audio or voice data to be processed and stored by the computer system. The signal generation device 108 includes an analog to digital converter to transform analog voice data to digital form which can be processed by the computer system. The signal generation device 108 also includes a specialized tape cassette player to input stored voice or audio data into the central processor 101 and the remainder of the system over bus 100. The signal generation device 108 also includes, as an output, a standard speaker for realizing the output audio from input signals from the computer system. Block 108 also includes well known audio processing hardware to transform digital audio data to audio signals for output to the speaker, thus creating an audible output.

The display device 105 utilized with the computer system and the present invention may be a liquid crystal device, cathode ray tube, or other display device suitable for creating graphic images and alphanumeric characters (and ideographic character sets) recognizable to the user. The cursor control device 107 allows the computer user to dynamically signal the two dimensional movement of a visible symbol (pointer) on a display screen of the display device 105. Many implementations of the cursor control device are known in the art including a trackball, mouse, joystick or special keys on the alphanumeric input device 105 capable of signaling movement of a given direction or manner of displacement. It is to be appreciated that the cursor means 107 also may be directed and/or activated via input from the keyboard using special keys and key sequence commands. Alternatively, the cursor may be directed and/or activated via input from a number of specially adapted cursor directing devices, including those uniquely developed for the disabled. In the discussions regarding cursor movement and/or activation within the preferred embodiment, it is to be assumed that the input cursor direction, device or push button may consist any of those described above and specifically is not limited to the mouse cursor device.

Figure 2:
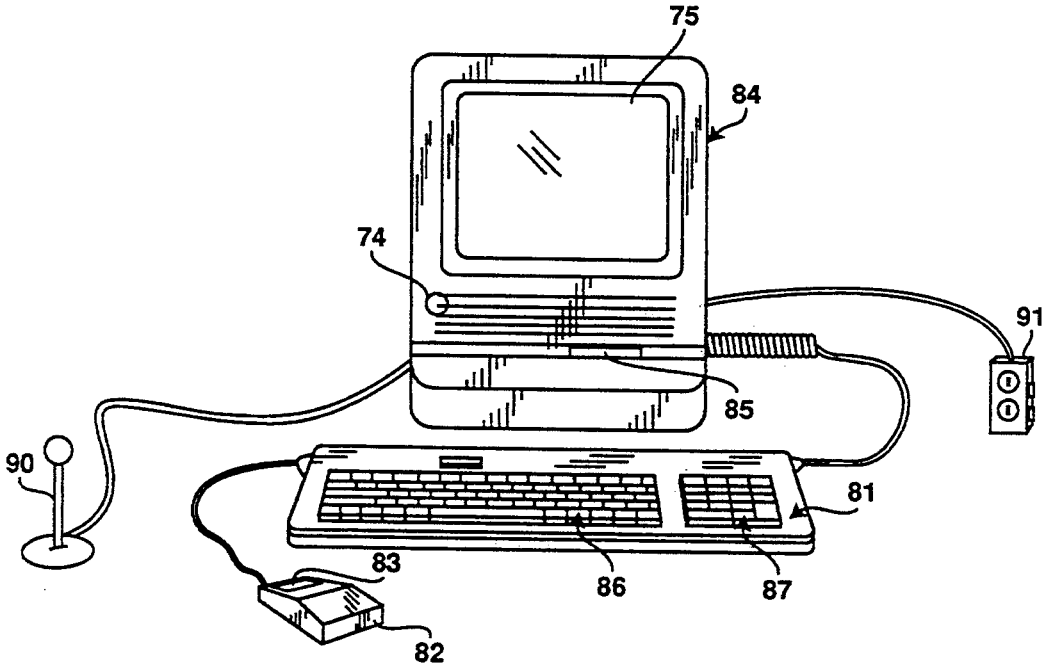
FIG. 2 represents a Macintosh TM platform of the present invention which provides an operational environment for the user interface with the present invention.

FIG. 2 illustrates the basic Apple computer system that is the environment used by the preferred embodiment of the present invention. It is appreciated that the Apple computer system is only one of many computer systems that may support the present invention. For purposes of clarity and as one example, the present invention is illustrated with the Apple computer system and operating with the SoundBrowser program. However, details specifically regarding the SoundBrowser program are not required for a clear and complete understanding of the present invention. FIG. 2 shows the Apple Macintosh TM computer 84 which is a particular implementation of the block diagram of FIG. 1. A keyboard 81 with keys 86 and keypad 87 is attached to the computer 84 along with a mouse device 82 and mouse push button 83 for controlling the cursor. The mouse device 82 and the push button 83 make up a cursor device. It is appreciated that many other devices may be used as the cursor device, for instance, the keyboard 81 may be substituted for the mouse device 82 and button 83 as just discussed above. The computer 84 also contains a disk drive 85 and a display screen 75.

An output speaker 74 is shown in its internal location within the computer system. The speaker will output the audio playback data to the user. An input microphone 90 is also illustrated in FIG. 2 attached to the computer system. Voice records and audio data are input through the microphone to the system. A specialized tape cassette recording device 91 is also illustrated coupled to the computer system. This device is capable of recording voice and audio data (as a standard tape recording device) while utilizing special marking functions to locate and identify certain audio segments. These markers or identifiers are placed on the magnetic tape by special push buttons located on the recorded and accessible by the user. The computer system is capable to controlling the cassette player 91 to locate audio data for playback and for initiating playback automatically or for causing the recorder to playback and then convert the audio signal for storage within the computer system. In this fashion, the audio data signal is generated and supplied to the processor applications of the present invention.

Figure 3:
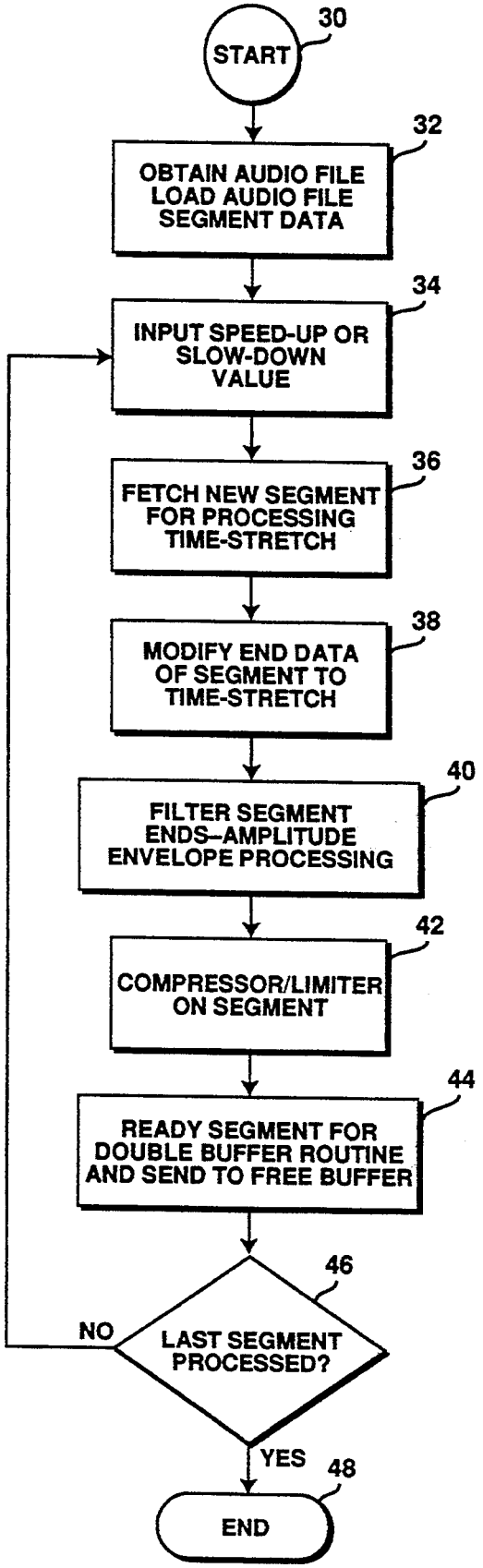
FIG. 3 is an overall flow chart of the basic functions and implementation of the present invention.

Program Interface of the Present Invention:

One aspect of the present invention is that no special hardware need be implemented within a desktop computer system, such as a Macintosh, to operate the present invention. The techniques employed by the present invention are implemented, in one embodiment, by software routines. There are several levels of routines that create the present invention. One level, or high level, controls the overall processing or flow of the present invention in order to realize the overall invention. This overall flow is indicated in FIG. 3. Other routines, or lower level functions, are directed by the high level flow to accomplish other tasks. Many of these low level functions are in reality routines within software tool managers called Sound Manager that are implemented on the Apple Macintosh computer system. The SoundBrowser creates an environment or "user-interface" implemented with the present invention while Sound Manager provides routines which are controlled and interrelated by functions and structure of the overall program flow.

In SoundBrowser, the computer-user is offered various ways of invoking the pitch maintenance system of the present invention. There is a sound-play-button, a sound-play-menu, and the user can open sound at any point by simply clicking, the mouse 82 and moving the mouse horizontally within a sound representation. For instance, once an audio data file is selected by the user for playback, a graphic image of the sound is displayed on the display device 75. This is employed by the cursor control device 107 and the display device 105. The vertical movements of the mouse 82 in the sound representation are used to allow the user to zoom in and out of the display sound. The sampled sound playback rate speed is controlled from a menu selected by the user.

The basic functions of the SoundBrowser, as utilized within the present invention, allow an end-user to open a sound file which was previously stored on the hard drive and display on the display screen of the computer system a graphical representation of the sample sound in a window on the display screen 75. Using well known functions a particular portion of this sample sound can then be selected by the user for playback. During this playback function is when the present invention operates.

Overall Flow of the Present Invention:

The overall computer implemented flow chart of the present invention is illustrated in FIG. 3. When a playback option has been selected in the SoundBrowser the following flow is initiated within the present invention. This flow chart has been produced to illustrate the major flow functions of the present invention and is presented in a way as to not obscure the present invention. It should be noted at the onset that each of the major functions the following overall flow discussion will be described in detail in separate sections to follow and that this flow discussion is to provide an overall understanding of the preferred embodiment of the present invention.

Sound data is stored in the audio data file continuously as binary values of amplitude. This amplitude has been sampled from an analog sound signal and there are 22,000 samples ("amplitudes") per second of sound. The present invention presses this sound in segments of 550 bytes each. Therefore, the term "segment" throughout the discussion refers to a block or buffer of the audio data file currently being processed.

The flow starts at block 30, the initialization mode, where a playback of a portion of previously stored audio data is requested. The present invention directs the computer to obtain a particular portion of the audio data file which is desired for playback at node 32. This information may be sent to the routine 32 automatically, or a user input device 106 and 107 may input this data directly from the user. Next, the requested data is then loaded so that the routine has access to the stored audio file. Next the flow proceeds to block 34 to input the speed up or slow down playback data which must come from the user originally. Again, this data may be automatically supplied to the routine by a previous user selection, or it may be supplied by an initial default value. Lastly, the user could update this value in real-time, as the program is operating to playback the recorded data.

The data supplied in and to block 34 includes playback rate data to indicate whether the user wants to increase ("speed up") the playback rate of the audio data or to decrease ("slow down") the playback rate of the audio data. Also, the user may supply in discrete levels, a particular amount of increase or decrease as desired. Although the present invention is not limited to playback rate increase and decrease values of a discrete nature, this format is a convenient way in which to interact with the computer user. The input device of the preferred embodiment of the present invention allows playback rate increase and decrease amounts based on semitone values. A semitone is a musical interval that devices an octave (two frequencies) into 12 more or less equal frequency steps. Therefore, the present invention allows the user to increase or decrease the playback rate based on discrete semitone values. The semitone is based on the segment update rate of the audio samples within the audio data file. The present invention processes audio data in sequential segments of 550 bytes each. Therefore, a semitone is approximately 550/12 or 46 bytes for example, a user can increase the playback rate of the audio file by 2 semitones, meaning 92 bytes will be skipped in between segments. This will be more fully discussed below.

Continuing with reference to the flow of FIG. 3, the present invention directs the computer to fetch a particular segment of the audio data, 550 bytes, for processing at block 36 as well as the start data of the next segment which is placed in a special start portion buffer. At block 36, a time stretching function is performing by varying the position of the audio data in which the selected segment is located. This process will be described in more detail further below. To increase playback rate, segments located on the audio tape are taken in sequence, but excluding semitone portions of audio data located between these segments. Playback rate is increased at block 36 depending on the result of the user input data of block 34. The flow next directs the computer to block 38 where the playback rate is decreased depending on the user input data of block 34. To decrease playback rate, the fetched segment is expanded by locating a particular portion of the segment data near the end and duplicating that data. The duplicate is then tacked onto the end of the segment increasing its size. This function is also a form of time stretching. By increasing the data length of each segment, the playback rate is decreased since longer time periods are required to process the audio file.

Segments are fetched in sequence from the audio tape and either block 36 will act to "cut" portions of the audio tape from the segments selected or block 38 will insert portions into these segments. In either case, when the segments are combined for output to sound processing hardware 108, they will be discontinuous due to the cutting and pasting. These discontinuities produce "clicks" and hissing distortion in the playback. Block 40 is designed to smooth out these disjunctions by filtering the junction areas of the audio data of the selected and processed segments. This filtering is accomplished by combining the data of the current segment fetched with a specialized parabolic function as well as combining the data with amplitude data points from prior segments already processed as well as the start of the amplitude data from the next segment found in the special start portion buffer. The filtering process is designed to fade in (amplitude increase) the start data points of the current segment and fade out (amplitude decrease) the end data points of the current segment.

Referring still to FIG. 3, next, the flow directs the computer to block 42 which performs a limiting function on the results of the filter block 40. Since the filter block 40 modifies amplitude data points of the fetched segment, these addition or subtraction functions may exceed the 8 bit format for the data. Therefore, the compressor block 42 will set to zero any value that results less than zero from the filter block or sets to 255 any value that exceeded 255 from the filter calculation.

Once the above blocks have been processed, the current segment is ready for output to the sound producing hardware 108. The present invention operates in real-time, therefore the hardware device must be continuously processing sound segments to keep the speaker busy generating an audible signal while the other data segments of the audio data file is being processed. Therefore, double buffering is performed at block 44 where the fetched and processed segment is placed for eventual output to the hardware processor while the hardware processor outputs the previous buffer. When the fetched segment is processed, block 44 checks to see if there is a Free buffer available. The processed segment is placed into the Free buffer by block 44. The overall process of the double buffering technique of the present invention involves an interrupt process whereby the flow of FIG. 3 calculates and loads a buffer into the Free buffer area for output while the flow of FIG. 4 handles the actual outputs and double buffers for audio signal generation. In this manner, the flow of FIG. 4 operates independently and in parallel with the flow of FIG. 3. Interrupt handling routines, that are well known, operate to properly link these flows.

Figure 4:
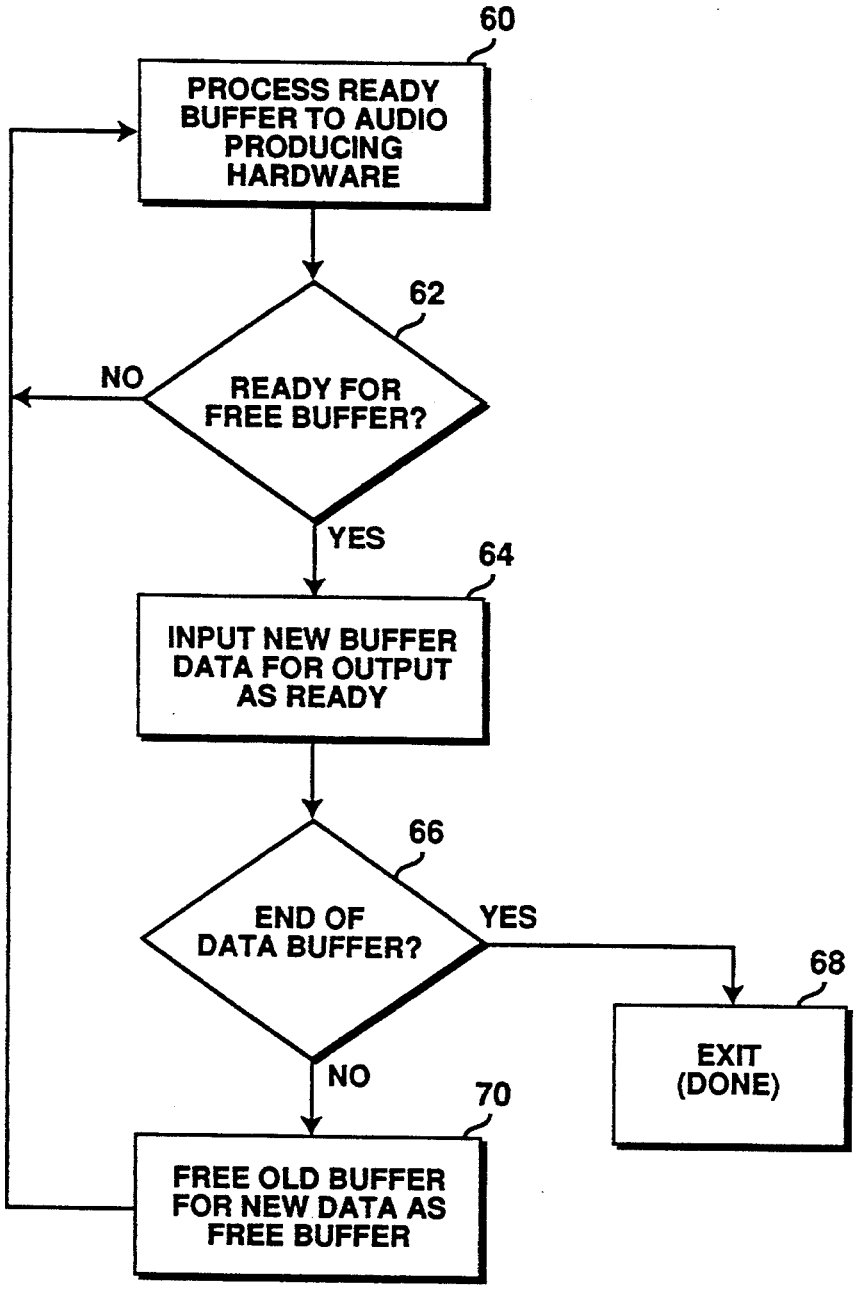
FIG. 4 is a flow chart of a double buffering function of the present invention.

Once block 44 has prepared the processed segment for output to the double buffering flow of FIG. 4, the present invention next directs the computer system to block 46 which checks the present audio file to determine if more segments require processing. If more segments are present within the audio data file then block 46 directs the computer back to block 34 in order to fetch and process and next segment of the audio data file. Notice that block 46 is directed back to block 34 and not block 36. This is so because the user may modify the playback rate in real-time as the segments are being processed and output. Therefore, block 34 checks and updates the playback rate data for each segment. If the last segment had been processed, then block 46 would have indicated this and the flow goes next to block 48 which ends the audio data processing segments of the present invention.

Referring to FIG. 4, this flow implements the double buffering technique which is interrupt driven with respect to the flow shown in FIG. 3, which is called the processor flow. The flow as illustrated of FIG. 4, called the double buffer flow, operates continuously, irrespective of the main processing flow of FIG. 3. The double buffer flow needs a processed segment loaded into the Free buffer in order for it to operate properly. The double buffer flow is a lower level function and begins at flow 60 and is cyclic in that it will cycle through buffers, outputting to the sound generation hardware until all the buffers are completed. The buffer that is ready to output to the sound producing hardware is called the Ready buffer and is output by the double buffer flow. This Ready buffer is a buffer that has been processed by the processor flow of FIG. 3 and inserted into a special buffer area within the double buffer flow by block 44 of processor flow then marked Ready by the buffer flow. The other buffer, the Free buffer, is the area that holds the most recently processed buffer while the Ready buffer is being output to the sound generation device. Block 44 of the processor flow inserts the processed segment into the Free buffer area.

The present invention directs block 60 to locate and fetch the Ready buffer and the start point of the buffer. Next, block 60 takes the audio data amplitudes, stored in binary form, and outputs this data to the sound producing hardware 108 of the computer system over bus 100. As stated before, the sound producing hardware required for the present invention is not specialized hardware and resides on all Macintosh models. It is appreciated that well known techniques can be utilized for generating audible sound from an input sound amplitude data file in binary format. These well known techniques are not discussed in depth herein as to not unnecessarily obscure the present invention and also because a variety of sound producing hardware systems can be advantageously utilized with the present invention.

Block 62 of FIG. 4 continuously checks to see if the end of the current Ready buffer has been reached after each data piece or "point" has been processed. If the end of the buffer has not been reached, then the buffer is continuously processed to the hardware 108. Once the buffer has ended, block 62 directs the computer system to block 64 where the next segment loaded by the processor flow (block 44) into the Free buffer is then taken as the next Ready buffer for output processing. Next block 66 checks to see if the last Ready buffer was the end of the audio data. If the end of the data was reached, then there will not be a next Free buffer waiting for input to block 64. The present invention will then direct the computer to block 68 where the double buffer routine will stop outputting to the hardware 16.

Referring still to FIG. 4, upon the presence of a new buffer from the processor flow, the computer is directed to operate block. 70. Block 70 first releases the old Ready buffer so it can be filled with new data. The old Ready buffer then becomes marked as the Free buffer. Block 70 then inputs the next segment waiting and marks that segment as the Ready buffer. Eventually the Free buffer will be filled by the processor flow (block 44) with the next segment for output. Next, block 70 loops back to block 60 to process the next Ready buffer. In this manner the double buffer flow operates on audio data segments while maintaining a continuous output audible signal.

The following discussions provide a more detailed description of the various functions and structures of the preferred embodiment of the present invention.

Double Buffering:

The present invention operates in real time. That is, the processing required to time stretch, filter, and compress the audio data must happen during the time while the audio data is currently playing continuously. There can be no perceptible delay period between the reading of the audio data from the file and the audible output. In other words, it is a function of the present invention that the computer user, when selecting an audio file to play, not be aware of the processing involved to accomplish the above tasks. For this reason double buffering is employed. Double buffering allows the sound data to be processed in segments, yet played continuously to the output.

Figure 5:
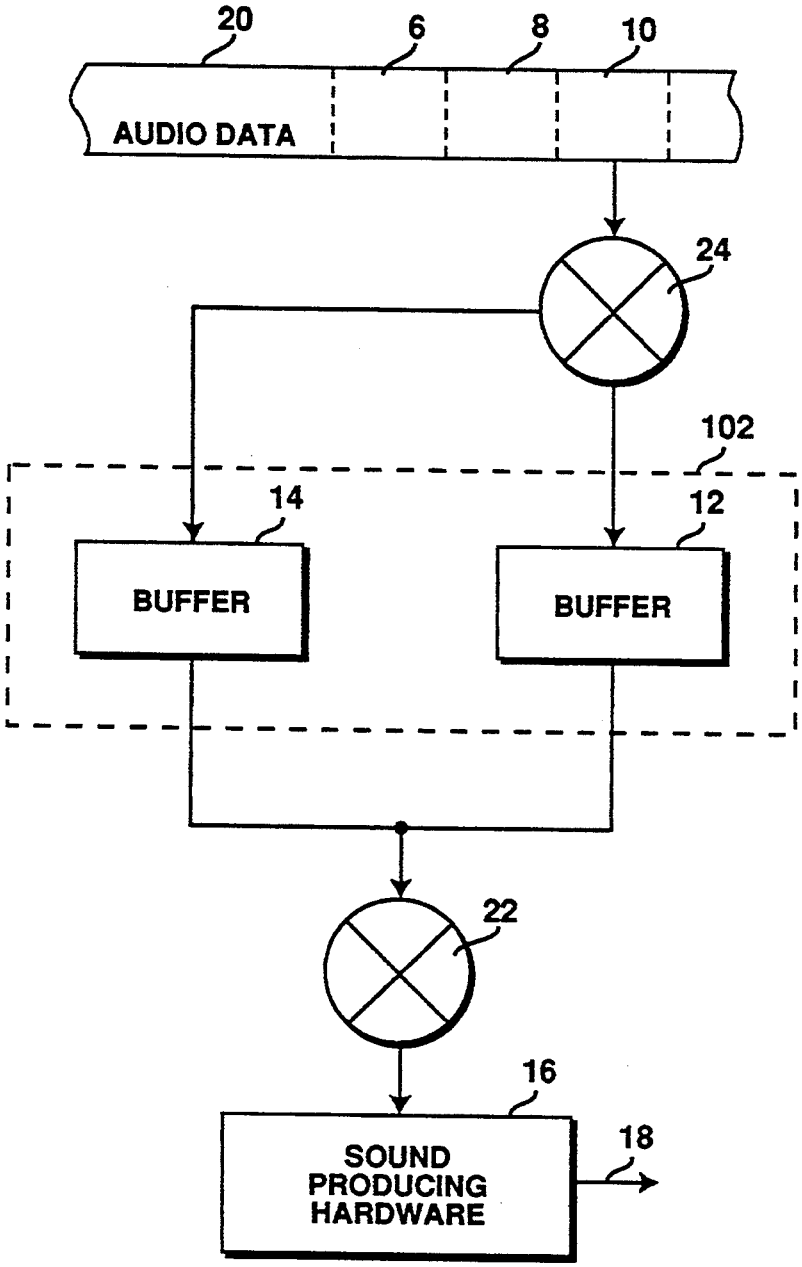
FIG. 5 is an illustration of a double buffering technique.
Figure 6A:
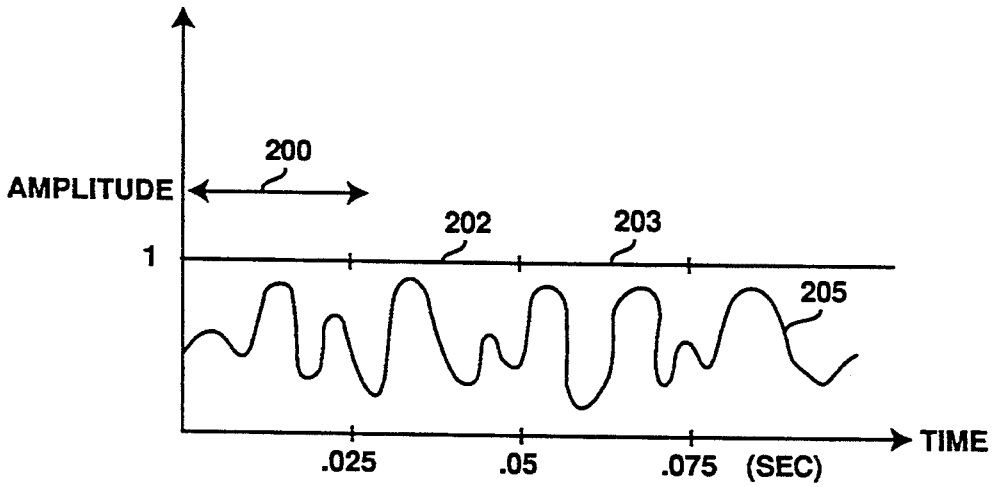
FIG. 6(*a*) is an illustration of continuous audio data stored on an audio data file and respective segments which make up the data.
Figure 6B:
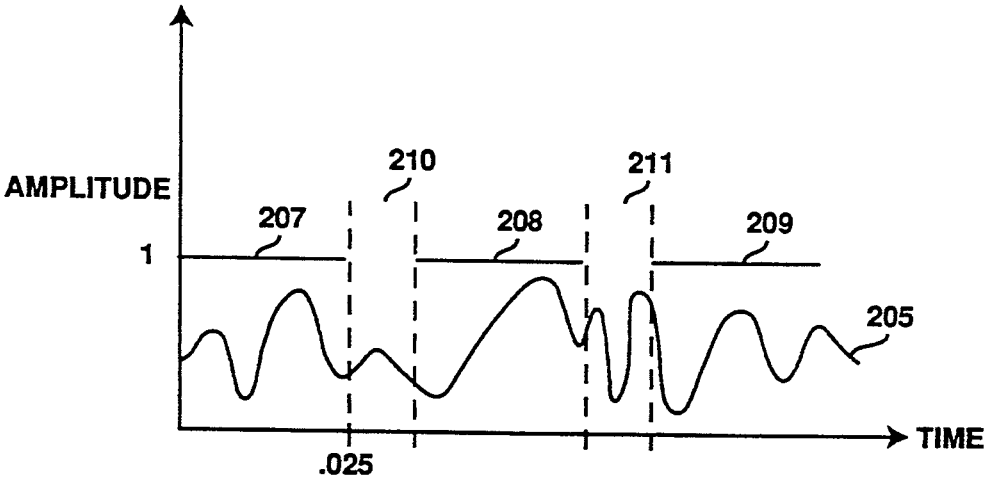
Figure 6C:
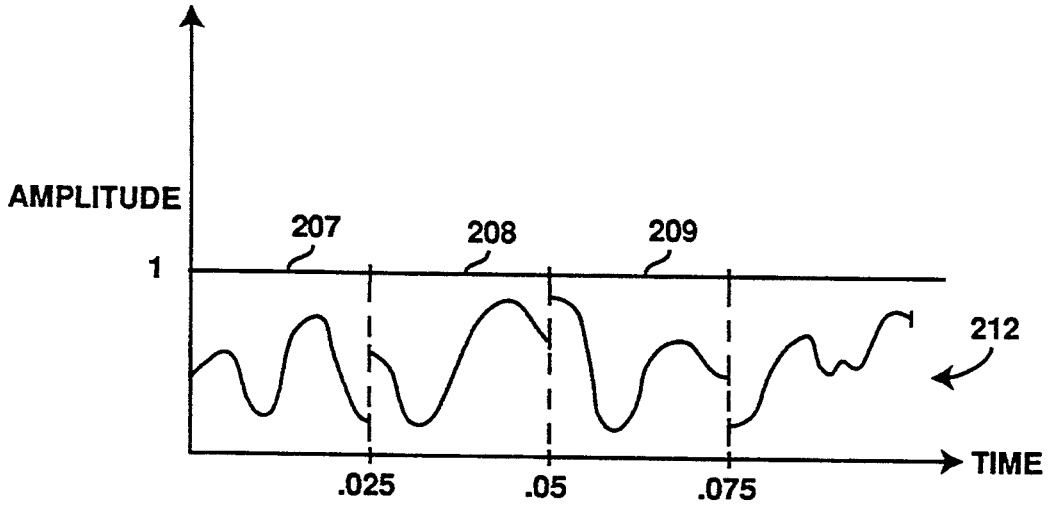
Figure 6D:
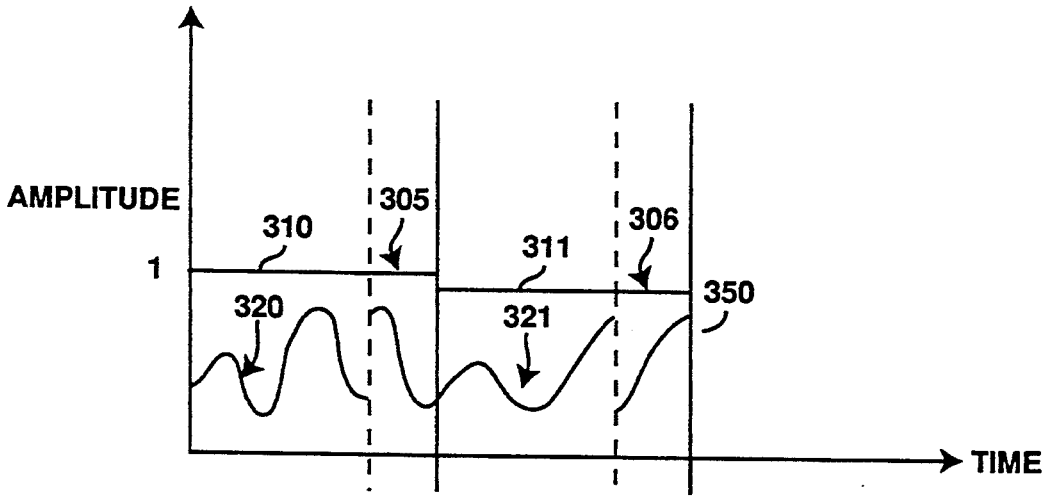

The double buffering technique employed by the present invention is disclosed. Audio data streams such as previously sampled sound usually reside on some storage medium like a hard disk or other data storage device 104. Referring to FIG. 5, the previously sampled sound has been stored on audio data stream 20. In one embodiment of the present invention the storage medium is a hard disk drive. In order for a previously sampled sound to be played by the computer system's sound producing hardware 16, the audio data 20 must be read from the hard disk, processed, and sent to the system's sound producing hardware. The process can be accomplished in several ways. If enough memory 102 within the computer system is available, the entire sampled sound can be read into the RAM and then sent to the sound producing hardware. This method is not available in most applications because of the large demand of memory generated by sound data. As stated before, up to 500 bytes of memory are required to generate only 25 milliseconds of audio sound.

Double buffering is utilized in one aspect of the present invention when there is not enough memory and processing power in the computer system to read into memory and process all of stored sound data at one time. The sample sound stream 20 is then read into memory 102 and then processed one piece at a time, consecutively, until each segment has been read, processed, and output. FIG. 5 illustrates two sample segments as segment 8 and segment 10. Segment 10 is first being read by the disk drive unit 104 (not shown), processed by the processor flow, and then fed into a special buffer 12 of the RAM 102. In FIG. 5, segment 8 is then the next segment to be processed by the computer system.

The technique of double buffering allows these consecutive segments to be processed by the sound producing hardware without delays or breaks occurring in the output sound from the sound producing hardware 108. Since each segment is processed at different times, it is possible for the sound producing hardware to not have any sound segments ready for processing while the storage unit 104 is attempting to download a new segment. This is the case because audio data segments 8, 10 are processed consecutively while output sound 18 is desired continuously. Therefore two buffers are utilized to perform the double buffering flow to prevent the above from occurring, and supplying a continuous flow of data to the sound producing hardware.

Double buffering, as shown in FIG. 5, is a technique where the computer system is used to first read in and process an audio segment 10 from data stream 20. The data segment 10 is then routed and placed into a Free buffer 12 in the computer's RAM memory 102 after being accessed from the storage unit or hard disk drive and processed by the processor flow. The Free buffer was ready to accept the data. This buffer 12 is then marked as "Ready to Play" for output to the sound producing hardware 16 and awaits routing to the hardware. At this point the buffer is no longer free. While the above occurs, buffer 14 is currently being output to the sound producing hardware 16 because it was the previous Ready buffer. Eventually when buffer 14 has been processed, it will be marked as the next Free buffer and buffer 12 will be output to the sound producing hardware by switching unit 22. While the sound producing hardware is processing buffer 12 to create the output signal at 18, the data stream updates so that the next consecutive segment 8 is read by the hard disk drive, processed, and then routed and placed into buffer 14 of the computer RAM 102 because this buffer was marked as free. This buffer 14 is then also marked "Ready to Play" by the computer system for eventual loading to the sound producing hardware 16 and is not free at this time. The system continues like this until all segments of the data stream 20 have been read and processed.

Therefore, there are two sampled sound buffers loaded into in RAM; one that is currently processed by the sound producing hardware 12 (a Ready buffer) and one that is being filled with sample sound data by block 44 of the processor flow (a Free buffer). As soon as the sound producing hardware 16 is done with its current buffer 12, it is routed and receives the other buffer 14 and continues processing to create a continuous output signal at 18. The buffer that was processed before 12 is now free to be filled with new sampled sound data from the next segment 6. Once buffer 12 has been filled, it will again be marked "Ready to Play" and routed and loaded to the hardware once the hardware is finished with buffer 14. The processing continues, switching back and forth between buffers 12 and 14 until the entire audio data stream 20 has been processed. In this manner a continuous audible sound stream at 18 can be produced while the data is read from the tape stream 20 in consecutive segments.

The speed at which Double-Buffering is performed depends on how big the buffers are and how fast the sound producing hardware processes them. The speed of the process is expressed in its read/write frequency. This number indicates how many times per second a buffer can be processed. Double-Buffering techniques read asynchronous sound producing hardware and asynchronous disk management capabilities. These requirements are found in most computer systems. The advantages of Double-Buffering are that low RAM requirements are needed and continuous sound production is possible from segments of data. Since low RAM requirements are needed many desktop computers can be advantageously with the present invention. The present invention operates the double buffering techniques at 25 milliseconds per segment update.

FIG. 5 illustrates the double buffering technique with routing circuits 22 and 24. Circuit 24 directs the input from data stream 20 to either buffer 12 or 14 depending on which buffer is marked as the Free buffer for loading. Router 22 directs to the input of the sound producing hardware 16 either the output of buffer 14 or 12 depending on the next buffer marked "Ready to Play." It is appreciated that the present invention can be realized using a variety of systems to accomplish this routing and buffer switching technique. These routing functions could be performed in hardware. i.e. using multiplexers or similar logic units as routers 24 and 22. The present invention utilizes a software control technique involving pointers in which the routing and Double-Buffering is performed by software routines accessing these pointers.

The core of the double buffering technique of the present invention is implemented with the low-level Macintosh Sound Manager routine called SndPlayDoubleBuffer(). The SoundBrowser Program sets up Sound Headers and a Sound Channel to perform the pointer functions. The Sound Manager handles all the low level interrupt based tasks that are needed to realize the Double-Buffering implementation. The SoundBrowser program supplies the routines that fill the Double-Buffers 12 and 14 with sample sound data, and the routines that process this data. It is appreciated that the present invention may be realized using any double buffering mechanism modeled after the discussions herein and that the use of the Sound Manager software is but one implementation. Therefore, the present invention should not be construed as limited to the Sound Manager environment.

Specifically within the Sound Manager toolbox, the function and associated parameters

```
TDSStart (long, playStart)
```

is utilized to invoke the playing of a sampled sound through the double buffer routines. This function passes the playStart parameter and a pointer to the global SoundDoubleBufferHeader on to the internal TDSSndPlay for further processing. TDSStart is invoked by user selection of the audio data file at block 32. The internal function

```
TDSSndPlay (SoundHeaderPtr sndHeader, long
  playStart)
```

calculates and stores final values such as the start point of the sound to be played and other information in the SoundDoubleBufferHeader, it also create a new Sound Channel and calls the low level Sound Manager SndPlayDoubleBuffer () routine to start playing via the double buffer routines. Calling of this function, passing its parameters and receiving its result code is handled by TDSStart () routine listed above. A SoundDoubleBufferHeader holds the information regarding the location of the processed segment for play (i.e., the Ready Buffer), the location of the filling routine (i.e., the processor flow), the sample rate of the data segment, and the sample size among other data fields. The relevant sections of the data header used with the present invention includes the following parameters:

- NumChannels Indicates the number of channels for the sound (2 for stereo, 1 for monophonic)
- SampleSize Indicates the sample size for the sound if the sound is not compressed. Samples that are 1–8 bits have a sample size of 8. Refer also to AIFF specification.
- SampleRate Indicates the sample rate for the sound.
- BufferPtr Indicates an array of two pointers, each of which should point to a valid SndDoubleBuffer record.
- DoubleBack Points to the application-defined routine that is called when the double buffers are switched and the exhausted buffer needs to be refilled.

The BufferPtr array contains pointers to two buffers. These are the two buffers between which the Sound Manager switches until all the sound data has been sent to the hardware 16, this would be the Ready Buffers and Free Buffers. Each buffer is structured to contain the number of data frames in the buffer, the buffer status, and the data array for output. In order to start the double buffering routine, two buffers must be initially sent. Following the first call to the double buffer routines the double back procedure (processor flow of the present invention) must refill the exhausted buffer (Free buffer) and mark the new buffer as the Ready buffer. This interface is handled by interrupts signaled by the double buffer routine.

Time Stretching (Blocks 36 and 38):

The portion of the present invention that performs the playback rate modification is called the time stretching routines. FIG. 6(*a*) illustrates sample sound data 205 located on the audio data file. Across the horizontal time is shown in seconds while amplitude of the sample sound is shown on the vertical. Three separate 25 millisecond segments 200, 202, and 203 are shown which correspond to the sample size of each segment read from the audio data, buffered and processed as described above. In the preferred embodiment of the present invention, these segments are 550 bytes in length and make up approximately 25 milliseconds of sound each. Therefore, 22,000 bytes or "samples" per second are taken to form the audio data stream 20. At 22 KHz, most of the frequencies found in sample sound will be captured by the digital representation of the sound or audio data stream 20. The data of each byte represents the amplitude in binary form of the sound at that sample point. The present invention stores and processes sound data in standard file formats such as AIFF and AIFF-C. (See Apple Computer, Inc. Audio Interchange File Format, Apple Programmers and Developers Association Software Releases, 1987–1988). The Macintosh TM computer processes sound in format 'snd' and well known techniques are available and utilized in the present invention to perform conversions between 'snd' format and AIFF and AIFF-C and vice versa. (See Apple Computer, Inc., the Sound Manager, Inside Macintosh Volume VI, Addison Wesley, April, 1991).

FIG. 6(*b*) illustrates time stretching of the present invention used to increase the playback rate of the audio data. Audio signal 205 represents the data of the audio data file. The first segment of audio data file 20 read by the processor flow is segment 207, however, the subsequent segment read 208 is not consecutive to segment 207. Segment 208 is read but portion 210 is skipped and ignored by the processor flow. This portion 210 is never processed or sent to the sound producing hardware 16. Segment 208 is processed as the next segment then portion 211 is skipped and segment 209 is read. Eventually the sound signal 205 is read piece by piece and skipping certain sound portions. The amount of sound skipped depend on the speed required by the computer user. As mentioned before the user may increase or decrease the speed of the playback in semitone levels. There are 12 semitones per sample. If the user desires to speed up the playback by 2 semitones, then (550/12) * 2 or 92 bytes are skipped within portion 210 and another 92 bytes are skipped within portion 211.

Referring still to FIG. 6(*b*), it should be appreciated that the present invention can skip any amount of bytes, up to the sample size of 550 bytes. However, a convenient user interface was selected based on easily selected semitones that forces the amount skipped into discrete amounts based on these semitones. The present invention therefore controls sample sound playback speed in semitone steps through multiplying the number of semitones by 46 bytes. If 550 bytes were skipped between segments, the resulting sampled sound will be twice as fast as the original. Because the double buffer process frequency is at 40 Hz, the resulting sampled sound will still have the original pitch but it will only have one half of the information that was in the original sample sound. It is appreciated that the present invention does not cut a portion of the audio data file larger then 25 milliseconds to make sure that no part of vowels or non-vowels is lost completely. For example, an 'i' or 'p' as in pick has a duration of 50 milliseconds and would be completely eliminated if larger cuts were possible.

FIG. 6(*c*) shows the sample sound 212 that results after the time stretching process as described above. It has the pitch of the original sound 205 but at every segment cut there is a discontinuous section or "break" where the two selected segments are joined. The pitch of sound 212 is the same as the original because the rate the data is supplied to the sound hardware is the same rate as was originally recorded, 22 KHz. These breaks are shown between segments 207 and 208, 208 and 209 and after segment 209. As can be seen, the resultant sound signal 212 is the same signal as 205 except that portions 210 and 211 have been clipped out and discarded. If sound signal 212 were played, it would contain a number of clicks or noise as a result of the sharp junctions between sampled segments. Each junction creating a click and since the junctions are approximately 25 milliseconds apart, the unwanted noise would be about 40 Hz which creates a low hum or buzz at the read/write frequency of the double buffers.

FIG. 6(*d*) illustrates the time stretching process employed to decrease the playback speed of the audio signal. Instead of cutting out portions of the sampled sound as shown in FIG. 6(*b*), this section of the present invention adds portions of sound to create the sound signal 350. The added portions are inserted in between the segments. The portion that is added is the tail end of the sampled segment replicated. The length of the amount replicated and added depends on the semitone decrease in playback rate desired. If the playback rate is desired to decrease by two semitones then the amount replicated and added will be 92 bytes, since each semitone is 46 bytes. For instance, segment 310 is the first section read from the audio tape, and assuming a two semitone decrease in playback rate, then the last 92 bytes of segment 310 are replicated to create portion 305 which is then added to the end of segment 310. The same is true for segment 311, the last 92 bytes are replicated to create portion 306 which is added to the end of segment 311. The resulting audio data signal 350 is shown in FIG. 6(*d*). As can be seen and appreciated, there are discontinuities within audio signal 350 just as with signal 212. These segment junctions having the discontinuities are seen between segment 310 and 305 and between segment 311 and 306. Again, these discontinuities create noise and clicks that must be smoothed out or the resultant playback will be of a poor quality.

Equal-Powered Cross-Fade Amplifier/Filter (block 40)

In order to solve the problem of the noises and clicks found in audio signals 212 and 350, the present invention employs a filtering means (block 40) to smooth out these portions in the processor flow. Generally, in order to reduce the noise, the filter smoothes out the junctions by fading out the trailing part of the old segment and fading in the start of the next segment. In do so the amplitude of the noise is decreased or filtered out. The fading process utilizes a parabolic function to fade out the old segment while fading in the new segment. If a regular parabolic function is utilized to perform this task, there is still some roll associated with the output signal.

Figure 7A:
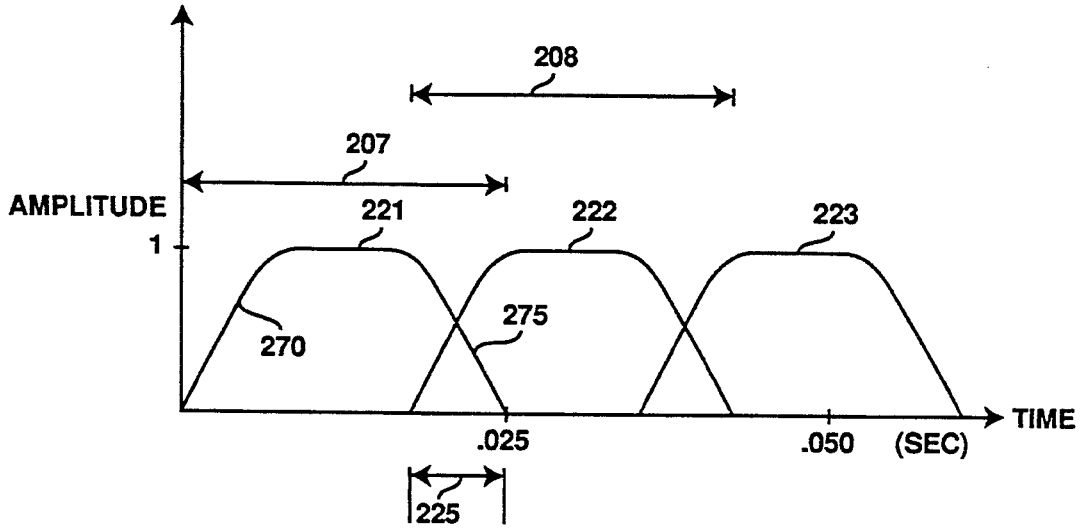
FIG. 7(*b*) is an illustration of the cross-fade amplitude filter of the present invention as filtering data segments.
Figure 7B:
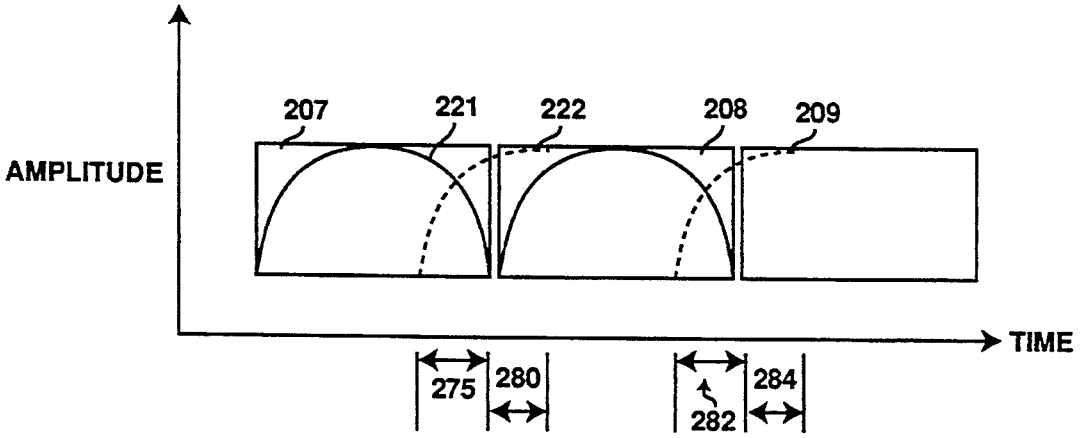
Figure 7C:
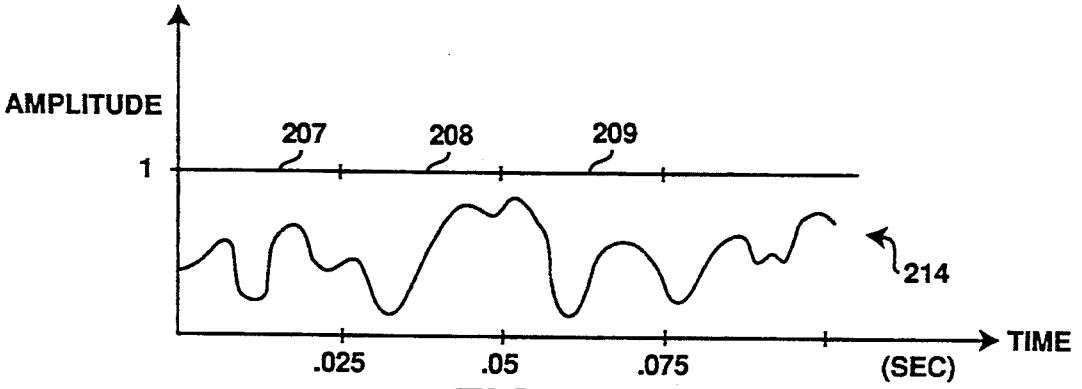

However, if a Cross-Fade Equal-Power function is utilized, whereby the parabolic functions cross at the segment junction, then the roll is almost complete reduced to zero. Such a Cross-Fade function is shown in FIG. 7(*a*) where the parabolic function amplitude(t)$=x^2$. This is an envelope graph illustrating the transformation of the sample segments. Where the graph function is amplitude of "1" then no change will be made to the sample segment at that location in time by the present invention. When the parabolic function dips down then the sample sound amplitude will be decreased at those points in time (fade out) and when the function rises then the sample sound amplitude will increase (fade in) at those points in time by the present invention. The function is called a Cross-Fade because the functions 221 and 222 cross through the point where the segments join, at region 225. It is an equal power function because in the area of the cross over the power is held equal as fade in and fade out functions will cross through functions 221 and 222.

The equal power cross fade function is applied to the start and the end of each of the segments. For this discussion, the start of a segment refers to the first 180 bytes of that segment and the end (or tail end) of a segment refers to the last 180 bytes of the segment. Each segment can be between 550 to 600 bytes long but when selected remains fixed during the processor flow.

Function 221 corresponds to the first segment read from the disk and processed, for example segment 207 of FIG. 6(*b*). At the starting data points of segment 207, the function 221 fades in the amplitude values of segment 207 over region 270 of function 221 by adding the parabolic function to the amplitude data points in region 270. Also region 275 of function 221 fades out the end portions of segment 207 by subtracting the parabolic function 221 from the amplitude data points in region 275. Since the functions cross, more calculations are done to achieve the actual filter data associated with segment 207. As shown, the upward function 222 crosses the downward portion of function 221. Function 222 corresponds to the next segment in sequence or 208. Therefore, the fade out portion of segment 207 is also combined with the fade in portion of segment 208 to arrive at the end data section of segment 207. This is the cross fade portion. The region 225 of segment 207 is therefore added with the start of segment 208.

In all there are four calculations that the present invention must perform for each side (start and end) to arrive at the final output segment for segment 207. FIG. 7(*b*) illustrates the calculations involved. First the end points of segment 207 must be located, those are the points corresponding to region 275 of function 221. Then the fade out (down slope region) of function 221 is applied to reduce the amplitude of the data points in region 275 of segment 207 to reduce the overall amplitude of segment 207. Next, the start points of the next segment 208 must be obtained and a fade in function, the rising slope of function 222, is applied to increase the data points of region 280 of segment 208. This result of segment 208 is finally added with the faded out end points of segment 207. The final result is the output segment that represents the end portion of sampled segment 207. The dashed line representing function 222 is present to illustrate that although the fade in starts at segment 208, it is used at the trailing end of segment 207 to form the final end result.

When segment 208 is next processed the start points of segment 208 will be faded in by the rising slope of function 222. Also, the end points of segment 207 will be faded out and also added with the faded in data of segment 208. This will create the start of the output segment corresponding to segment 208. The end of segment 208 will be processed similar to the end of segment 207. First the data for the end of segment 208 is faded out, then added with the faded in data of the start of segment 209. Each segment must go through this process. It should be mentioned that segment 207 also undergoes a fade in calculation that involves the end points of the segment that came before segment 207.

The overall processing required to produce a sample segment can be summarized with respect to segment 208. First, the start values (region 280) of segment 208 are faded in by increasing the amplitude data points according to the up swing portion of function 222. Then added to these a modified start points of segment 208 are the end points (region 275) of segment 207 that have been faded previously. Next, the end points, region 282, of segment 208 are faded out by function 222 and added to the start points (region 284) of segment 209 that have been faded in by function 223. By combining the segment data in the above manner, a cross fade results.

By performing the above calculations, the present invention performs a fade in and fade out process to produce an output signal with rounded or smooth junctions forms. This is illustrated at FIG. 7(*c*). The amplitude values of the segments at the junctions between segments 207, 208 and 209 have been modified to eliminate the discontinuities and therefore remove the associated clicks and noises. The resulting signal 214 is then output to the Free buffer by the processor flow (block 44) and eventually it is output to the sound producing hardware 16 (by way of the double buffer flow) to create a continuous audible sound.

It is appreciated that after a segment has been fully processed and output to the Free buffer, an image of this processed segment is stored by the present invention and supplied to block 40 because that data will be used in performing the filtering functions of the next segment. In the present invention, only the start and end data of the first processed segment are stored because only those will be used in calculating the next segment in the processor flow.

Compressor/Limiter (Block 42):

Because the data byte for the sampled sounds of the segments are only 8 bit, the present invention employs a limiter in order to keep the results of the filter stage within the range of zero to 255. If the fade in amplitude values exceed 255, this could cause a binary roll over and generate noise. For this reason, the present invention will set to 255 any amplitude value exceeding 255. Similarly, any fade out amplitude value that is less than zero will be set to zero to prevent any roll over through zero or clipping of the binary byte. By so doing, the present invention eliminates the clicks and noise associated with binary overroll within the segments processed which create discontinuities in the output sound.

"Double" Double-Buffering:

In order to increase processing efficiency, the present invention also utilizes a form of "double" double buffering. Instead of processing only one segment at a time, one embodiment of the present invention processes two semi-segments together in the same segment buffer. Each semi-segment is read from the audio data file (and time stretched) then both semi-segments are loaded into a segment buffer in sequence. Each semi-segment is then processed just like the segment processing as described herein. For instance, the processor flow processes each semi-segment as it would process a segment. The two processed semi-segments are then sent to the double buffering routine together in the same segment buffer. The double buffering routine is therefore tricked into processing two semi-segments for every Ready buffer supplied by the processor flow.

For a single segment process, the processor flow fetches a new segment, processes it, and then delivers it to the double buffering routines, then fetches the next segment. So, the processor flow loops once for every double buffer delivery. Under the double double-buffer method, a different order is accomplished. The processor flow must process both semi-segments per segment fetch cycle. This is the case since both semi-segments are processed and output to the double buffer routines before the processor flow retrieves two new semi-segments. Therefore, the processor flow loops twice through for every double buffer delivery of the Ready buffer. In this case the Ready buffer would hold two processed semi-segments in sequence. Using this advantageous system, the present invention can increase the processing speed of the overall flow while using the same double buffer routines thus reducing the overall complexity of the system.

Elimination of Pitch Distortion:

Throughout the discussion above, the amount of data within the audio data file was either cut out or added to the output file, but the overall frequency of the data was never altered or modified to change the playback rate. Therefore, the overall pitch of the output data was never changed. Instead the amount of data processed from the original was reduced or expanded. Thus, an advantageous method of modifying, in real time, the playback rate of a previously stored audio data file without pitch distortion has been disclosed in detail. The present invention also maintains gender information and affect due to effective time-stretching and filtering routines.

The preferred embodiment of the present invention, a computer implemented system for modifying in real-time the playback of audio data without pitch distortion noise, is thus described. While the present invention has been described in one particular embodiment, it should be appreciated that the present invention should not be construed as limited by such embodiment, but rather construed according to the below claims.

INTRODUCTION

The implementation of the pitch maintenance algorithm and its programmatic interfaces is accomplished using eleven routines. Eight of these routines are accessed from other parts of SoundBrowser. All routines start with, or contain, the acronym TDS to discriminate them from other routines used in the SoundBrowser software.

Routines that are Accessed from SoundBrowser

OSErr TDSInitCreate (void);

This function is called as SoundBrowser starts up, It allocates the Double-Buffers, locks them in memory and returns an operating system result code if something goes wrong there. Next, it initializes the Cross-Fade buffers, these are stack-based so they don't have to be allocated.

Possible result codes: noErr, memFullErr

OSErr TDSCreate (short soundResID);

TDSCreate creates and initializes a SoundDoubleBufferHeader given the sound who's resource ID is passed in the soundResID parameter. This function is called upon opening a new sound file. The routine stores the offset to global variables and addresses of structures and routines in the Sound DoubleBuffer-Header.

Possible result codes: noErr, memFullErr

OSErr TDSStart (long playStart);

This function invokes the playing of a sampled sound through the Double-Buffer routines. It passes the playStart parameter and a pointer to the global SoundDoubleBufferHeader on to internalTDSSndPlay for further processing. TDSStart is invoked by user actions as mentioned in the User-Interface section. If something goes wrong in internalTDSSndPlay, the error result code is returned via this function.

Possible result codes: noErr, badChannel void TDSMessage (short curSpeed);

TDSMessage is called from the SoundBrowser menu-handler. This procedure calculates the number of bytes to skip per Double-Buffer action given the semitone value in the curSpeed parameter. This parameter is passed by the menu-handler.

Boolean TDSIsPlaying (void);

This function returns true while the sound producing hardware is processing a sound. It is called from various other parts of SoundBrowser that need continuous updates on sound management.

void TDSStop (void);

the TDSStop procedure is called every time a sound is stopped playing. It releases the Sound Channel that was allocated by internalTDSSndPlay and updates a number of global variables.

void TDSDispose (void);

This procedure is called every time a sound file is closed, it disposes the memory used by the sampled sound and the SoundDoubleBufferHeader that was allocated for the sound.

void TDSExitKill (void);

The TDSExitKill procedure is called upon SoundBrowser exit, it unlocks and disposes the memory space used by the double buffers that was allocated by TDSInitCreate.

Routines that are Used Internally

OSErr internalTDSSndPlay (SoundHeaderPtr sndHeader, long playStart);

Calling of this function, passing its parameters and receiving its result code is handled by TDSStart as described earlier. The routine calculates and stores final values such as the start point of the sound to be played and other information in the SoundDoubleBufferHeader, it creates a new Sound Channel and it calls the low-level Sound Manager SndPlayDoubleBuffer routine to start playing via the Double-Buffering process.

Possible result cedes: noErr, badChannel pascal void internalTDSDBProc (SndChannelPtr channel, SndDoubleBufferPtr doubleBufferPtr);

The internalTDSDBProc procedure is called by the low-level Sound Manager interrupt routines that handle Double-Buffering. It contains error-preventing assembly language code around a call to actualTDSDBProc. The channel and doubleBufferPtr parameters are supplied by the Sound Manager and passed to actualTDSDBProc.

pascal Boolean actualTDSDBProc (SndDoubleBufferPtr doubleBufferPtr);

This function is called from internalTDSDBProc as described above. Here's where the actual copying and processing of the sampled sound takes place, on interrupt level. first, the routine fills the Double-Buffer that was passed from the Sound Manager with a new chunk of sampled sound that it reads from disk. Then, the chunk is processed with the Equal-Powered Cross-Fade and Compressor/Limiter algorithms. Finally, the chunk is marked ready for the Sound Manager. If the sampled sound has been processed completely, the function returns false to signal that the Double-Buffering process can be stopped.

Inside Macintosh, Volume VI

Field Descriptions smMaxCPULoad The maximum load that the Sound Manager will not exceed when allocating channels. The smMaxCPULoad field is set to a default value of 100 when the system starts up.

smNumChannels The number of sound channels that are currently allocated by all applications. This does not mean that the channels allocated are being used, only that they have been allocated and that CPU loading is being reserved for these channels.

smCurCPULoad The CPU load that is being taken up by currently allocated channels.

Listing 22—22 illustrates the use of SndManagerStatus. It defines a function that returns the number of sound channels currently allocated by all applications.

Listing 22—22. Determining the number of allocated sound channels

```
FUNCTION NumChannelsAllocated : Integer;
VAR
    myErr:        OSErr;
    mySMStatus:   SMStatus;
BEGIN
    NumChannelsAllocated := 0;
    myErr := SndManagerStatus (Sizeof(SMStatus),
    @mySMStatus);
    IF myErr = noErr THEN
      NumChannelsAllocated := mySMStatus.smNumChannels;
END;
```

Using Double Buffers

The play-from-disk routines make extensive use of the SndPlayDoubleBuffer function. You can use this function in your application if you wish to bypass the normal play-from-disk routines. You might want to do this if you wish to maximize the efficiency of your application while maintaining compatibility with the Sound Manager. By using SndPlayDoubleBuffer instead of the normal play-from-disk routines, you can specify your own doubleback procedure (that is, the algorithm used to switch back and forth between buffers) and customize several other buffering parameters.

> Note: SndPlayDoubleBuffer is a very low-level routine and is not intended for general use. You should use SndPlayDoubleBuffer only if you require very fine control over double buffering.

You call SndPlayDoubleBuffer by passing it a pointer to a sound channel (into which the double-buffered data is to be written) and a pointer to a sound double-buffer header. Here's an example:

```
myErr:=SndPlayDoubleBuffer (mySndChan,
  @myDoubleHeader);
```

A SndDoubleBufferHeader record has the following structure:

```
TYPE SndDoubleBufferHeader =
    PACKED RECORD
      dbhNumChannels:     Integer;        {number of sound channels}
      dbhSampleSize:      Integer;        {sample size, if uncompressed}
      dbhCompressionID:   Integer;        {ID of compression algorithm}
      dbhPacketSize:      Integer;        {number of bits per packet}
      dbhSampleRate:      Fixed;          {sample rate}
      dbhBufferPtr:       ARRAY[0..1] OF SndDoubleBufferPtr;
                                          {pointers to SndDoubleBuffer}
      dbhDoubleBack:      ProcPtr         {pointer to doubleback procedure}
    END;
```

Field Descriptions dbhNumChannels Indicates the number of channels for the sound (1 for monophonic sound, 2 for stereo).

dbhSampleSize Indicates the sample size for the sound if the sound is not compressed. If the sound is compressed, dbhSampleSize should be set to 0. Samples that are 1–8 bits have a dbhSampleSize value of 8; samples that are 9–16 bits have a dbhSampleSize value of 16. Currently, only 8-bit samples are supported. For further information on sample sizes, refer to the AIFF specification.

dbhCompressionID Indicates the compression identification number of the compression algorithm, if the sound is compressed. If the sound is not compressed, dbhCompressionID should be set to 0.

dbhPacketSize Indicates the packet size for the compression algorithm specified by dbhCompressionID, if the sound is compressed.

dbhSampleRate Indicates the sample rate for the sound. Note that the sample rate is declared as a Fixed data type, but the most significant bit is not treated as a sign bit; instead, that bit is interpreted as having the value 32,768.

dbhBufferPtr Indicates an array of two pointers, each of which should point to a valid SndDoubleBuffer record.

dbhDoubleBack Points to the application-defined routine that is called when the double buffers are switched and the exhausted buffer needs to be refilled.

The values for the dbhCompressionID, dbhNumChannels, and dbhPacketSize fields are the same as those for the compressionID, numChannels, and packetSize fields of the compressed sound header, respectively.

The dbhBufferPtr array contains pointers to two records of type SndDoubleBuffer. These are the two buffers between which the Sound Manager switches until all the sound data has been sent into the sound channel. When the call to SndPlayDoubleBuffer is made, the two buffers should both already contain a nonzero number of frames of data.

Here is the structure of a sound double buffer:

```
TYPE SndDoubleBuffer =
    PACKED RECORD
      dbNumFrames:     LongInt;                    {number of frames in buffer}
      dbFlags:         LongInt;                    {buffer status flags}
      dbUserInfo:      ARRAY[0..1] OF LongInt;     {for application's use}
      dbSoundData:     PACKED ARRAY[0..0] OF Byte
                                                   {array of data}
```

-continued

```
END;
```

Field Descriptions dbNumFrames The number of frames in the dbSoundData array.

dbFlags Buffer status flags.

dbUserInfo Two long words into which you can place information that you need to access in your doubleback procedure.

dbSoundData A variable-length array. You write samples into this array, and the synthesizer reads samples out of this array.

The buffer status flags field for each of the two buffers may contain either of these values:

```
CONST   dbBufferReady     = $00000001;
        dbLastBuffer      = $00000004;
```

All other bits in the dbFlags field are reserved by Apple, and your application should not modify them.

The following two sections illustrate how to fill out these data structures, create your two buffers, and define a doubleback procedure to refill the buffers when they become empty.

Setting Up Double Buffers

Before you can call SndPlayDoubleBuffer, you need to allocate two buffers (of type SndDoubleBuffer), fill them both with data, set the flags for the two buffers to dbBufferReady, and then fill out a record of type SndDoubleBufferHeader with the appropriate information. Listing 22-23 illustrates how you might accomplish these tasks.

Listing 22-23. Setting up Double Buffers

```
CONST
    kDoubleBufferSize = 4096;        {size of each buffer (in bytes)}
TYPE
    LocalVarsPtr = ^ LocalVars;
    LocalVars =                      {variables used by doubleback proc}
    RECORD
      bytesTotal:    LongInt;        {total number of samples}
      bytesCopied:   LongInt;        {number of samples copied to buffers}
      dataPtr:       Ptr             {pointer to sample to copy}
    END;
{This function uses SndPlayDoubleBuffer to play the sound specified.}
FUNCTION DBSndPlay (chan: SndChannelPtr; sndHeader: SoundHeaderPtr) :
                    OSErr;
VAR
    myVars:        LocalVars;
    doubleHeader:  SndDoubleBufferHeader;
    doubleBuffer:  SndDoubleBufferPtr;
    status:        SCStatus;
    i:             Integer;
    err:           OSErr;
BEGIN
    {set up myVars with initial information}
    myVars.bytesTotal := sndHeader ^ .length;
    myVars.bytesCopied := 0;                    {no samples copied yet}
    myVars.dataPtr := Ptr(@sndHeader ^ .sampleArea[0]);
                                                {pointer to first sample}
    {set up SndDoubleBufferHeader}
    doubleHeader.dbhNumChannels := 1;           {one channel}
    doubleHeader.dbhSampleSize := 8;            {8-bit samples}
    doubleHeader.dbhCompressionID := 0;         {no compression}
    doubleHeader.dbhPacketSize := 0;            {no compression}
    doubleHeader.dbhSampleRate := sndHeader ^ .sampleRate;
    doubleHeader.dbhDoubleBack := @MyDoubleBackProc;
    FOR i := 0 TO 1 DO                          {initialize both buffers}
    BEGIN
      {get memory for double buffer}
      doubleBuffer := SndDoubleBufferPtr(NewPtr(Sizeof(SndDoubleBuffer) +
                                          kDoubleBufferSize));
      IF doubleBuffer = NIL THEN
        BEGIN
          DBSndPlay := MemError;
          DoError;
        END;
      doubleBuffer ^ .dbNumFrames := 0;         {no frames yet}
      doubleBuffer ^ .dbFlags := 0;             {buffer is empty}
      doubleBuffer ^ .dbUserInfo[0] := LongInt(@myVars);
      {fill buffer with samples}
      MyDoubleBackProc(sndChan, doubleBuffer);
      {store buffer pointer in header}
      doubleHeader.dbhBufferPtr[i] := doubleBuffer;
    END;
```

Inside Macintosh, Volume VI

Listing 22-23. Setting up Double Buffers (Continued)

```
    {start the sound playing}
    err := SndPlayDoubleBuffer(sndChan, @doubleHeader);
    IF err <> noErr THEN
      BEGIN
        DBSndPlay := err;
        DoError;
      END;
    {wait for the sound to complete by watching the channel
    status}
    REPEAT
      err := SndChannelStatus(chan, sizeof(status), @status);
    UNTIL NOT status.scChannelBusy;
    {dispose double-buffer memory}
    FOR i := 0 TO 1 DO
      DisposPtr(Ptr(doubleHeader.dbhBufferPtr[i]));
    DBSndPlay := noErr;
END;
```

The function DBSndPlay takes two parameters, a pointer to a sound channel and a pointer to a sound header. It reads the sound header to determine the characteristics of the sound to be played (for example, how many samples are to be sent into the sound channel). Then DBSndPlay fills in the fields of the double-buffer header, creates two buffers, and starts the sound playing. The doubleback procedure MyDoubleBackProc is defined in the next section.

Writing a Doubleback Procedure

The dbhDoubleBack field of a double-buffer header specifies the address of a doubleback procedure, an application-defined procedure that is called when the double buffers are switched and the exhausted buffer needs to be refilled. The doubleback procedure should have this format:

PROCEDURE MyDoubleBackProc (chan: SndChannelPtr; exhaustedBuffer: SndDoubleBufferPtr);

The primary responsibility of the doubleback procedure is to refill an exhausted buffer of samples and to mark the newly filled buffer as ready for processing. Listing 22-24 illustrates how to define a doubleback procedure. Note that the sound-channel pointer passed to the doubleback procedure is not used in this procedure.

This doubleback procedure extracts the address of its local variables from the dbUserInfo field of the double-buffer record passed to it. These variables are used to keep track of how many total bytes need to be copied and how many bytes have been copied so far. Then the procedure copies at most a buffer-full of bytes into the empty buffer and updates several fields in the double-buffer record and in the structure containing the local variables. Finally, if all the bytes to be copied have been copied, the buffer is marked as the last buffer.

Note: Because the doubleback procedure is called at interrupt time, it cannot make any calls that move memory either directly or indirectly. (Despite its name, the BlockMove procedure does not cause blocks of memory to move or be purged, so you can safely call it in your doubleback procedure, as illustrated in Listing 22-24.)

Listing 22-24. Defining a Doubleback Procedure

```
PROCEDURE MyDoubleBackProc (chan: SndChannelPtr; doubleBuffer:
                            SndDoubleBufferPtr);
VAR
    myVarsPtr:      LocalVarsPtr;
    bytesToCopy:    LongInt;
BEGIN
    {get pointer to my local variables}
    myVarsPtr := LocalVarsPtr(doubleBuffer ^ .dbUserInfo[0]);
    {get number of bytes left to copy}
    bytesToCopy := myVarsPtr ^ .bytesTotal - myVarsPtr ^ .bytesCopied;
    {If the amount left is greater than double-buffer size, }
    { then limit the number of bytes to copy to the size of the buffer.}
    IF bytesToCopy > kDoubleBufferSize THEN
      bytesToCopy := kDoubleBufferSize;
    {copy samples to double buffer}
    BlockMove(myVarsPtr ^ .dataPtr, @doubleBuffer ^ .dbSoundData[0],
          bytesToCopy);
    {store number of samples in buffer and mark buffer as ready}
    doubleBuffer ^ .dbNumFrames := bytesToCopy;
    doubleBuffer ^ .dbFlags := BOR(doubleBuffer ^ .dbFlags, dbBufferReady);
    {update data pointer and number of bytes copied}
    myVarsPtr ^ .dataPtr := Ptr(ORD4(myVarsPtr ^ .dataPtr) + bytesToCopy);
    myVarsPtr ^ .bytesCopied := myVarsPtr ^ .bytesCopied + bytesToCopy;
    {If all samples have been copied, then this is the last buffer.}
    IF myVarsPtr ^ .bytesCopied = myVarsPtr ^ .bytesTotal THEN
      doubleBuffer ^ .dbFlags := BOR(doubleBuffer ^ .dbFlags, dbLastBuffer);
END;
```

Specifying Callback Routines

The SndNewChannel function allows you to associate a completion routine or callback procedure with a sound channel. This procedure is called whenever a callBackCmd command is received by the synthesizer linked to that channel, and the procedure can be used for various purposes. Generally, your application uses a callback procedure to determine that the channel has completed its commands and to arrange for disposal of the channel. The callback procedure cannot itself dispose of the channel because it may execute at interrupt time. A callback

What is claimed is:

1. A computer implemented apparatus for modifying a playback rate of previously stored audio data without varying playback pitch of said audio data, said audio data composed of a plurality of discrete data points stored in said computer, said computer implemented apparatus comprising:

buffer processing means for supplying audio data, said buffer processing means switching between a first buffer and a second buffer;

time stretching means for modifying said playback rate of said audio data said time stretching means coupled to said buffer processing means, said time stretching means comprising:

(a) means for reading a first segment of said audio data and for reading a second segment of said audio data, said first and second segments in sequence but not necessarily consecutive;

(b) means for increasing said playback rate of said audio data by extending said first and second segments by replicating and reincorporating portions of said first segment and said second segment; and (c) means for decreasing said playback rate of said audio data by excluding predetermined segments of said audio data located between said first segment and said second segment;

means for reducing roll associated with a junction between said first segment and said second segment, said means for reducing roll comprising filtering means for fading out predetermined end data points of said first segment and for fading in predetermined start data points of said second portion, said filtering means coupled to said time stretching means, said filtering means comprising:

first filter means for applying a first filter to only said predetermined end data points of said first segment to fade out said predetermined end data points;

second filter means for applying a second filter to only said predetermined start data points of said second segment to fade in said predetermined start data points, wherein said first filter and said second filter comprise an equal power cross fade filter arrangement and wherein said first filter and said second filter are equal at said junction; and means for adding results generated from said first filter means and said second filter means to generate an output signal; and limiting means for constraining said output signal of said filtering means to operate within a predetermined range of fade in and fade out values, said limiting means coupled to receive said output signal from said filtering means.

2. A computer implemented apparatus as described in claim 1 further comprising:

audio output means for inputting a signal of audio data and for outputting an audible signal therefrom;

wherein said buffer processing means contains a first buffer available for processing and a second buffer not available for processing for direct output to said audio output means, said buffer processing means coupled to said audio output means; and means for placing said first segment or said second segment into said first buffer or said second buffer depending on a status of said buffer processing means.

3. A computer implemented apparatus as described in claim 2 wherein said limiting means forces to zero said fade in and fade out values that are less than zero and forces to a maximum of said predetermined range of values said fade in and fade out values that exceed said predetermined range of values.

4. A computer implemented apparatus as described in claim 3 wherein said predetermined range of values of said limiting means is the binary range within 8 bits.

5. A computer implemented apparatus as described in claim 1 further comprising user data input means for indicating a particular audio data for use, said user data input means responsive to inputs from a computer user, said user input means coupled to said time stretching means.

6. A computer implemented apparatus as described in claim 1 further comprising playback rate input means for indicating whether said time stretching means increases or decreases said playback rate of said audio data, said playback rate input means responsive to inputs from a computer user, said playback rate input means coupled to said time stretching means.

7. A computer implemented apparatus for increasing or decreasing playback rate of a previously stored audio data file without increasing or decreasing playback pitch of said audio data file, said computer implemented apparatus comprising:

(a) first buffer means for storage of said audio data file;

(b) time stretching means for selecting a first portion of a predetermined length of said audio data file from said first buffer means, said first portion having a start and an end point, said time stretching means also for selecting a second portion of a predetermined length of said audio data file from said first buffer means, said second portion having a start and an end point, said time stretching means comprising:

(i) means for excluding intermediate data of said audio data file located between said end point of said first portion and said start point of said second portion, said means for excluding coupled to receive said first portion and said second portion; and (ii) means for increasing said first portion by replicating said end point of said first portion and also for increasing said second portion by replicating said end point of said second portion, said means for increasing coupled to receive said first portion and said second portion;

(c) filter means for fading out said end point of said first portion and for fading in said start point of said second portion to reduce roll, said filter means coupled to receive output from said time stretching means, said filter means comprising:

first filter means for applying a first filter to only said end point of said first portion to fade out said predetermined end point;

second filter means for applying a second filter to only said start point of said second portion to fade in said start point, wherein said first filter and said second filter comprise an equal power cross fade filter arrangement; and means for adding results generated from said first filter means and said second filter means to generate an output signal; and (d) audio processing means coupled to said filter means for outputting a continuous audible signal based on said output signal.

8. A computer implemented apparatus as described in claim 7 further comprising a limiting means for limiting said filter means such that said fading in and said fading out are constrained within a predetermined domain, said limiting means coupled to said filter means and also coupled to said audio processing means.

9. A computer implemented apparatus as described in claim 8 wherein said predetermined domain is from zero to 255.

10. A computer implemented apparatus as described in claim 8 implemented on and with a Macintosh desktop computer by Apple Computer Incorporated.

11. A computer implemented apparatus as described in claim 8 further comprising a user input means for selecting said audio data file for loading into said first buffer means, said user input means coupled to said first buffer means.

12. A computer implemented apparatus as described in claim 7 wherein a portion is ready for output to said audio processing means after said time stretching means has selected said portion and said filter has faded in and faded out said portion; and wherein said audio processing means outputs said first portion after said first portion is ready for output while said time stretching means selects said second portion and said filter fades in and fades out said second portion.

13. A computer implemented apparatus as described in claim 7 wherein said first portion and said second portion are composed of audio sound data having signal amplitude; and wherein said first filter and said second filter of said equal power cross fade arrangement are parabolic functions.

14. A computer implemented apparatus as described in claim 13 wherein said end point of said first portion includes the last ten to twenty percent of said first portion; and wherein said start point of said second portion includes the first twenty to thirty-five percent of said second portion.

15. A computer implemented apparatus as described in claim 7 wherein said first portion and said second portion are composed of audio sound data having signal amplitude; and wherein said first filter and said second filter of said equal power cross fade arrangement are parabolic functions.

16. A computer implemented apparatus as described in claim 7 wherein said intermediate data excluded by said means for excluding is from 0 to 25 percent in length of said first portion.

17. A computer implemented apparatus as described in claim 7 wherein said means for excluding intermediate data of said audio data file which are located between said end point of said first portion and said start point of said second portion is utilized to increase said playback rate of said audio data file; and wherein said means for increasing the length of said end point of said first portion by replicating said end of said first portion and also for increasing the length of said end point of said second portion by replicating said end point of said second portion is utilized to decrease said playback rate of said audio data file.

18. A computer implemented apparatus as described in claim 17 further comprising a user input means for selecting said audio data file for loading into said first buffer means and also for indicating whether said time stretching means decreases or increases said playback rate, said user input means coupled to said first buffer means.

19. A computer implemented apparatus as described in claim 18 wherein said playback rate is increased by increasing a length of said intermediate data excluded by said means for excluding and wherein said playback rate is decreased by replicating a larger amount of said end point on said first and said second segments by said means for increasing.

20. A computer implemented apparatus for modifying a playback rate of a stored audio data file while maintaining original pitch of said stored audio data file and while also maintaining a high sound quality of said stored audio data file, said computer implemented apparatus comprising:

(a) selection means for selecting and storing a particular stored audio data file for output;

(b) processing means for processing successive segments of said stored audio data file, said processing means coupled to said selection means, said processing means comprising:

(i) time stretching means for selecting a first segment of said stored audio data file, said first segment of a predetermined length, said time stretching means also for selecting a second segment of said stored audio data file of predetermined length, said second segment following said first segment in sequence but not necessarily successive, said time stretching means for excluding a portion of said stored audio data file residing between said first segment and said second segment;

(ii) filter means for reducing roll by fading out end points of said first segment and fading in start points of said second segment in order to provide a smooth junction between said first and said second segments, said filter means coupled to said time stretching means, said filter means comprising:

first filter means for applying a first filter to only said end points of said first segment to fade out said end points;

second filter means for applying a second filter to only said start points of said second segment to fade in said start points, wherein said first filter and said second filter comprise an equal power cross fade filter arrangement wherein said first filter and said second filter have equal power at said junction; and means for adding results generated from said first filter means and said second filter means to generate an output signal; and (c) buffering means for holding a first buffer containing said second segment which is being processed by said processing means and for holding a second buffer containing said first segment which has already been processed by said processing means, said buffering means coupled to receive said output signal of said processing means.

21. A computer implemented apparatus as described in claim 20 further comprising audio output means for generating an audible signal based on said first segment held in said second buffer of said buffering means, said audio output means coupled to said buffering means.

22. A computer implemented apparatus as described in claim 20 further comprising a limiting means for limiting fade in and fade out ranges of said first and said second segments as filtered by said filter means, said limiting means coupled to said filter means.

23. A computer implemented apparatus as described in claim 22 wherein said processing means further comprises replicating means for expanding said first and said second segments by replicating said end points of said first and said second segments.

24. A computer implemented apparatus as described in claim 23 wherein said first segment and said second segment are composed of audio sound data having signal amplitude; and wherein said first filter and said second filter of said equal power cross fade filter arrangement are parabolic functions.

25. A computer implemented apparatus as described in claim 23 wherein said end points of said first segment include the last twenty to thirty-five percent of said first segment; and wherein said start points of said second segment include the first twenty to thirty-five percent of said second segment.

26. A computer implemented apparatus as described in claim 23 implemented on and with a Macintosh desktop computer manufactured by Apple Computer Incorporated of Cupertino, Calif.

27. A computer implemented apparatus as described in claim 23 wherein said selection means is a user input means for selecting said audio data file for loading into said first buffer means.

28. A computer implemented apparatus as described in claim 23 wherein said time stretching means excludes said portion of data between said first segment and said second segment to increase said playback rate of said audio data file; and wherein said replicating means for expanding said first and said second segments by replicating said end points of said first and said second segments is utilized to decrease said playback rate of said audio data file.

29. A computer implemented apparatus as described in claim 23 wherein said selection means further comprises a user input means for selecting said audio data file and also for indicating whether said time stretching means decreases or increases said playback rate, said user input means responsive to inputs from a computer user, said user input means coupled to said processing means.

30. A computer implemented apparatus as described in claim 22 wherein said portion of data excluded by said time stretching means is from 0 to 25 percent in length of said first segment.

31. A computer implemented method for increasing or decreasing playback rate of a previously stored audio data file in a first buffer without increasing or decreasing playback pitch of said audio data file, said method comprising the computer implemented steps of:

(a) selecting a first portion of a predetermined length of said audio data file from said first buffer, said first portion having a start point and an end point, (b) selecting a second portion of a predetermined length of said audio data file from said first buffer, said second portion having a start point and an end point;

(c) modifying said playback rate of said audio data file by either:

(i) excluding intermediate data of said audio data file located between said end point of said first portion and said start point of said second portion; or (ii) expanding said first portion by replicating said end point of said first portion and expanding said second portion by replicating said end point of said second portion;

(d) smoothing a junction between said first portion and said second portion to reduce roll by filtering said first portion and said second portion by fading out said end point of said first portion and fading in said start point of said second portion, said step of filtering receiving audio data output from said step of modifying, said step of filtering further comprising the steps of:

applying a first filter to only said end point of said first portion to fade out said end point;

applying a second filter to only said start point of said second portion to fade in said start point, wherein said first filter and said second filter comprise an equal power cross fade filter arrangement and wherein said first filter and said second filter are equal in value at said junction; and adding results generated from said step of applying a first filter and said step of applying a second filter to generate an output signal: and (e) outputting a continuous audible signal based on said output signal by first processing said first portion and then consecutively processing said second portion.

32. A computer implemented method as described in claim 31 further comprising the computer implemented step of limiting said filtering step such that said fading in and said fading out are constrained within a predetermined domain.

33. A computer implemented method as described in claim 32 wherein said method accesses said audio data file and outputs said continuous audible signal in real-time.

34. A computer implemented method as described in claim 32 implemented on and with a Macintosh desktop computer manufactured by Apple Computer Incorporated.

35. A computer implemented method as described in claim 32 further comprising the computer implemented step of providing a user input for selecting said audio data file for loading into said first buffer.

36. A computer implemented method as described in claim 32 further including the computer implemented step of responding to a computer user input which indicates whether said step of modifying said playback rate decreases or increases said playback rate.

37. A computer implemented method as described in claim 31 wherein said first portion is output by said step of outputting a continuous audible signal while said second portion is still undergoing said step of modifying said playback rate and said step of filtering.

38. A computer implemented method as described in claim 31 wherein said first portion and said second portion are composed of audio sound data having signal amplitude; and wherein said first filter and said second filter of said step of filtering are parabolic functions.

39. A computer implemented method as described in claim 38 wherein said end point of said first portion includes the last twenty to thirty-five percent of said first portion; and wherein said start point of said second portion includes the first twenty to thirty-five percent of said second portion.

40. A computer implemented method as described in claim 31 wherein said intermediate data excluded by step of excluding is from 0 to 25 percent in length of said first portion.

41. A computer implemented method as described in claim 31 wherein step of excluding intermediate data of said audio data file which are located between said end point of said first portion and said start point of said second portion is utilized to increase said playback rate of said audio data file; and wherein said step of expanding said first portion by replicating said end of said first portion and increasing second portion by replicating said end point of said second portion is utilized to decrease said playback rate of said audio data file.

42. A computer implemented apparatus for modifying a playback rate of audio data without varying playback pitch of said audio data, said audio data composed of a plurality of discrete data points, said computer implemented apparatus comprising:

buffer processing logic supplying audio data, said buffer processing logic switching between a first buffer and a second buffer;

time stretching logic modifying said playback rate of said audio data received from said buffer processing logic, said time stretching logic coupled to said buffer processing logic, said time stretching logic comprising:

(a) read logic reading a first segment of said audio data and for reading a second segment of said audio data, said first and second segments in sequence but not necessarily consecutive;

(b) increasing logic increasing said playback rate of said audio data by extending said first and second segments by replicating and reincorporating portions of said first segment and said second segment, said increasing logic coupled to said read logic; and (c) decreasing logic decreasing said playback rate of said audio data by excluding predetermined segments of said audio data located between said first segment and said second segment, said decreasing logic coupled to said read logic;

filtering logic fading out only end data points of said first segment and fading in only start data points of said second segment to smooth a junction between said first segment and said second segment, said filtering logic coupled to said time stretching logic, said filtering logic comprising:

first filter logic for applying a first filter to only said end data points of said first segment to fade out said end data points;

second filter logic for applying a second filter to only said start data points of said second segment to fade in said start data points, wherein said first filter and said second filter comprise an equal power cross fade filter arrangement and wherein said first filter and said second filter are equal at said junction; and logic for adding results generated from said first filter logic and said second filter logic to generate an output signal; and limiting logic constraining said output signal from said filtering logic so that said fading out and said fading in operate within a predetermined range of fade in and fade out values, said limiting logic coupled to receive said output signal of said filtering logic.

43. A computer implemented apparatus as described in claim 42 further comprising user data input device responsive to inputs from a computer user, wherein said increasing logic and said decreasing logic of said time stretching logic are responsive to said user data input device for increasing or decreasing said playback rate of said audio data file.

44. A computer implemented apparatus for modifying a playback rate of audio data without varying playback pitch of said audio data, said audio data composed of a plurality of discrete data points, said computer implemented apparatus comprising:

buffer processing logic supplying audio data, said buffer processing logic switching between a first buffer and a second buffer;

time stretching logic modifying said playback rate of said audio data received from said buffer processing logic, said time stretching logic coupled to said buffer processing logic, said time stretching logic comprising:

(a) read logic reading a first segment of said audio data and for reading a second segment of said audio data, said first and second segments in sequence but not necessarily consecutive;

(b) increasing logic increasing said playback rate of said audio data by extending said first and second segments by replicating and reincorporating portions of said first segment and said second segment, said increasing logic coupled to said read logic; and (c) decreasing logic decreasing said playback rate of said audio data by excluding predetermined segments of said audio data located between said first segment and said second segment, said decreasing logic coupled to said read logic;

filtering logic fading out only predetermined data points of said first segment and fading in only predetermined data points of said second portion to smooth a junction between said first segment and said second segment, said filtering logic coupled to said time stretching logic, said filtering logic comprising:

first filter logic applying a first filter to only predetermined end data points of said first segment to fade out said predetermined end data points;

second filter logic applying a second filter to only predetermined start data points of said second segment to fade in said predetermined start data points, wherein said first filter and said second filter comprise an equal power cross fade filter arrangement and wherein said first filter and said second filter are equal in value at said junction; and logic for adding results generated from said first filter logic and said second filter logic to generate an output signal; and limiting logic constraining said output signal from said filtering logic so that said fading out and said fading in operates within a predetermined range of fade in and fade out values, said limiting logic coupled to said filtering logic.

45. A computer implemented apparatus as described in claim 44 wherein said first filter and said second filter of said filtering logic are parabolic functions.

46. A computer implemented apparatus as described in claim 44 further comprising user data input device responsive to inputs from a computer user, wherein said increasing logic and said decreasing logic of said time stretching logic are responsive to said user data input device for increasing or decreasing said playback rate of said audio data file.

* * * * *